US011673388B2

(12) United States Patent
Tomimatsu et al.

(10) Patent No.: US 11,673,388 B2
(45) Date of Patent: Jun. 13, 2023

(54) LIQUID EJECTING HEAD AND LIQUID EJECTING APPARATUS

(71) Applicant: Seiko Epson Corporation, Tokyo (JP)

(72) Inventors: Shingo Tomimatsu, Shiojiri (JP); Katsuhiro Okubo, Azumino (JP); Hiroki Kobayashi, Matsumoto (JP); Takahiro Kanegae, Shiojiri (JP)

(73) Assignee: SEIKO EPSON CORPORATION

( * ) Notice: Subject to any disclaimer, the term of this patent is extended or adjusted under 35 U.S.C. 154(b) by 60 days.

(21) Appl. No.: 17/359,978

(22) Filed: Jun. 28, 2021

(65) Prior Publication Data

US 2021/0402771 A1 Dec. 30, 2021

(30) Foreign Application Priority Data

Jun. 29, 2020 (JP) ..... JP2020-111944

(51) Int. Cl.
*B41J 2/14* (2006.01)

(52) U.S. Cl.
CPC ..... *B41J 2/14145* (2013.01); *B41J 2/14233* (2013.01); *B41J 2002/14419* (2013.01)

(58) Field of Classification Search
CPC ..... B41J 2/14145; B41J 2/14233; B41J 2002/14419; B41J 2002/14362; B41J 2202/08; B41J 2202/20; B41J 2/01; B41J 2/045; B41J 2/14
See application file for complete search history.

(56) References Cited

U.S. PATENT DOCUMENTS

2011/0316935 A1* 12/2011 Sato ..... B41J 2/14274 347/63
2012/0256989 A1 10/2012 Uezawa et al.
2019/0283429 A1 9/2019 Tanaka

FOREIGN PATENT DOCUMENTS

JP 2010-214743 A 9/2010
JP 2011-201222 A 10/2011
JP 2012-011560 A 1/2012
JP 2012-171319 A 9/2012
JP 2016-097568 A 5/2016
JP 2019-155839 A 9/2019

OTHER PUBLICATIONS

IP.com search (Year: 2022).*
Machine Translation of JP 2004082716 A Mar. 18, 2004, Paragraphs 0001, 0022-0038 (Year: 2004).*

* cited by examiner

*Primary Examiner* — Lisa Solomon
(74) *Attorney, Agent, or Firm* — Harness, Dickey & Pierce, P.L.C.

(57) ABSTRACT

A plurality of head chips including: a nozzle plate having a plurality of nozzles configured to eject a liquid in a first direction, and a case having one or more first flow paths communicating with at least a part of the plurality of nozzles; a holder to which the plurality of head chips are fixed, which includes metal or ceramics, and which has a plurality of second flow paths communicating with at least one of the plurality of first flow paths; and a heater configured to heat the holder.

19 Claims, 19 Drawing Sheets

LIQUID EJECTING HEAD AND LIQUID EJECTING APPARATUS

The present application is based on, and claims priority from JP Application Serial Number 2020-111944, filed Jun. 29, 2020, the disclosure of which is hereby incorporated by reference herein in its entirety.

BACKGROUND

1. Technical Field

The present disclosure relates to a liquid ejecting head and a liquid ejecting apparatus for ejecting a liquid from a nozzle, particularly to an ink jet type recording head and an ink jet type recording apparatus for ejecting ink as a liquid.

2. Related Art

A liquid ejecting apparatus represented by an ink jet type recording apparatus, such as an ink jet type printer or plotter, includes a liquid ejecting head that is capable of ejecting a liquid, such as ink stored in a cartridge, a tank or the like, as liquid droplets.

The liquid ejecting head includes a head chip provided with a nozzle for discharging a liquid, and a holder for holding a plurality of head chips.

The liquid discharged from such a liquid ejecting head has a viscosity suitable for the type of liquid. Since the viscosity of a liquid correlates with temperature, the lower the viscosity, the higher the viscosity, and the higher the temperature, the lower the viscosity. Therefore, it is necessary to heat the liquid when the liquid ejecting head designed to be suitable for the viscosity of the liquid normally used is placed in a low temperature environment or when the liquid having a high viscosity is discharged. A configuration in which a heater is provided in the liquid ejecting head for heating the liquid is disclosed (for example, refer to JP-A-2016-97568 and JP-A-2019-155839).

Specifically, JP-A-2016-97568 discloses a configuration in which a connection portion that includes a first heater in a frame that holds a plurality of flow path modules, includes a second heater in a second tank for supplying a liquid, and connects the flow path module and the second tank to each other, is provided.

JP-A-2019-155839 discloses a configuration in which a heater for heating each of the head chip cases is provided.

However, in JP-A-2016-97568, since the periphery of the connection portion is in contact with the outside, when supplying the ink in the second tank which is heated by the second heater to the flow path module through the connection portion, the heat is dissipated from the connection portion and the temperature of the ink supplied to the flow path module decreases. To compensate for this, the flow path module is heated by the first heater through a frame and a nozzle plate, but the frame and the nozzle plate are in contact with the outside air, and thus, the heat of the first heater is also dissipated from there, and there is a concern that the ink in the flow path module is not be sufficiently heated.

As in JP-A-2019-155839, it is conceivable that heaters are provided corresponding to each head chip to heat the inside of the head chip, but there is a problem that the configuration becomes complicated by providing the heater in the vicinity of the nozzle. Specifically, as the heater is disposed in the vicinity of the nozzle, the length of the wiring connected to the heater increases, the routing of the wiring becomes necessary, and the configuration becomes complicated.

Such a problem is not limited to the ink jet type recording head that ejects the ink, and also exists in the liquid ejecting head that ejects the liquid other than ink.

SUMMARY

In view of such circumstances, the present disclosure is to provide a liquid ejecting head and a liquid ejecting apparatus that can supply a liquid sufficiently heated by a heater to a head chip, and can simplify the structure without necessity of heating the head chip by a holder configured of a material having high thermal conductivity.

According to an aspect of the present disclosure, there is provided a liquid ejecting head including: a plurality of head chips having a nozzle plate having a plurality of nozzles for ejecting a liquid in a first direction, and a case in which one or more first flow paths communicating with at least a part of the plurality of nozzles are formed; a holder to which the plurality of head chips are fixed, which includes metal or ceramics, and which has a plurality of second flow paths communicating with at least one of the plurality of first flow paths; and a heater that heats the holder.

According to another aspect of the present disclosure, there is provided a liquid ejecting apparatus including: the liquid ejecting head according to the above-described aspect; and a holding member that holds the liquid ejecting head and includes metal, in which a part of the holding member is disposed so as to sandwich the head outer wall with the heater.

According to still another aspect of the present disclosure, there is provided a liquid ejecting apparatus including: the liquid ejecting head according to the above-described aspect; and a holding member that holds the liquid ejecting head and includes resin, in which a part of the holding member is disposed so as to sandwich the head outer wall with the heater.

According to still another aspect of the present disclosure, there is provided a liquid ejecting apparatus including: the liquid ejecting head according to the above-described aspect; and a holding member that holds the liquid ejecting head and includes resin, in which a part of the holding member is disposed so as to sandwich the heater with the holder.

According to still another aspect of the present disclosure, there is provided a liquid ejecting apparatus including: the liquid ejecting head according to the above-described aspect; and a control unit that controls the heater.

According to still another aspect of the present disclosure, there is provided a liquid ejecting apparatus including: the liquid ejecting head according to the above-described aspect; and a liquid container for storing a liquid ejected from the liquid ejecting head.

DESCRIPTION OF EXEMPLARY EMBODIMENTS

Figure 1:
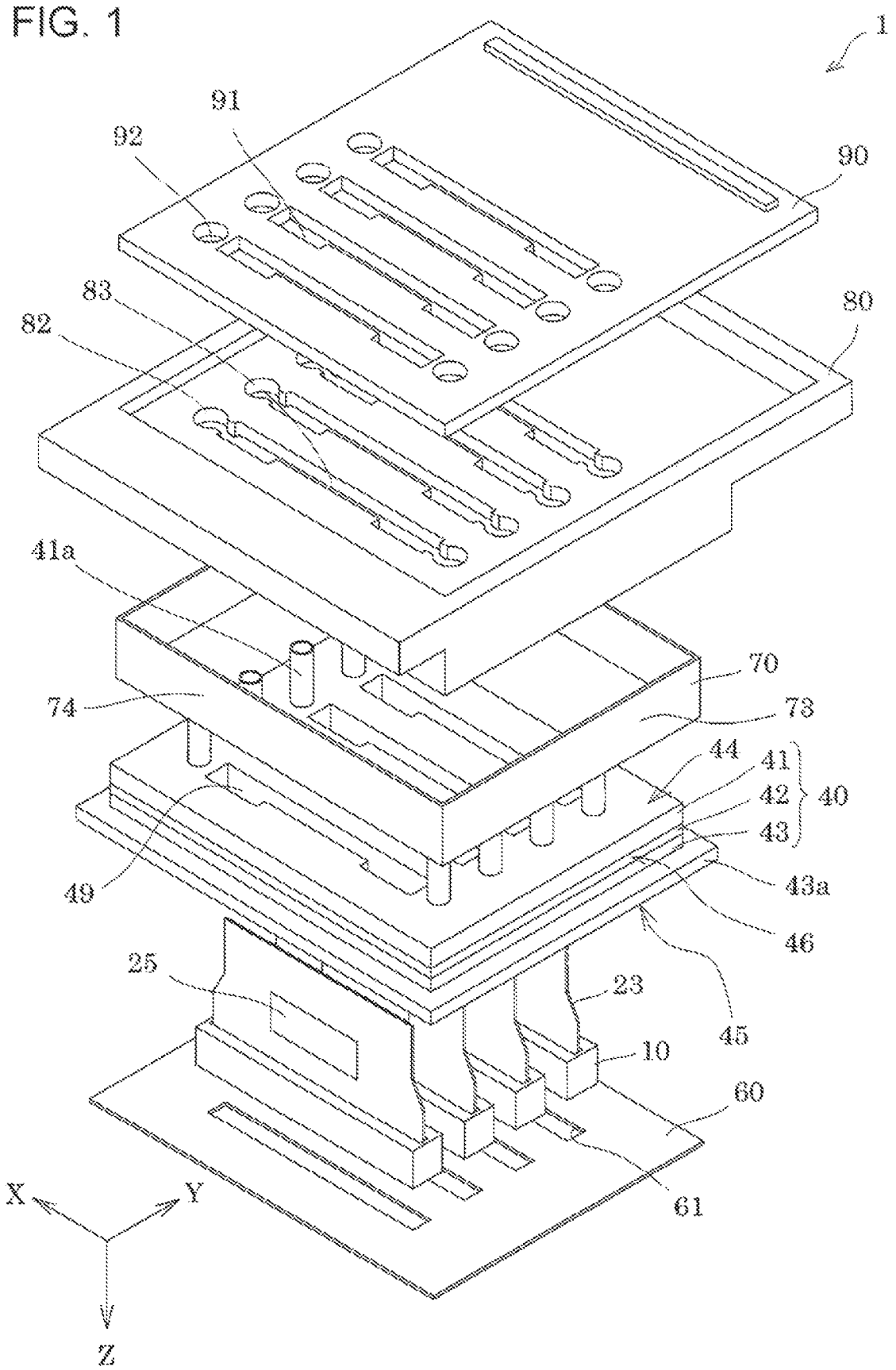
FIG. 1 is an exploded perspective view of a recording head according to Embodiment 1.

Hereinafter, the disclosure will be described in detail based on embodiments. However, the following description shows one aspect of the disclosure, and can be changed in any manner within the scope of the disclosure. Those having the same reference numerals in each drawing indicate the same members, and the description thereof will be omitted as appropriate. In each of the drawings, X, Y, and Z represent three spatial axes orthogonal to each other. In the specification, the directions along these axes are the X direction, the Y direction, and the Z direction. The direction in which the arrows in each drawing are oriented is described as the positive (+) direction, and the opposite direction of the arrows is described as the negative (−) direction. The Z direction indicates a vertical direction, the +Z direction indicates a vertically downward direction, and the −Z direction indicates a vertically upward direction. Furthermore, the three spatial axes that do not limit the positive direction and the negative direction will be described as the ±X direction, the ±Y direction, and the ±Z direction.

Embodiment 1

FIG. 1 is an exploded perspective view of an ink jet type recording head 1 which is an example of the "liquid ejecting head" according to Embodiment 1 of the disclosure.

As illustrated in the drawing, the ink jet type recording head 1 (hereinafter, also simply referred to as the recording head 1), which is an example of the "liquid ejecting head" of the embodiment, has a plurality of head chips 10 and a holder 40 that holds the plurality of head chips 10. In the embodiment, four head chips 10 are disposed side by side in the +Y direction orthogonal to the +Z direction in one holder 40. In the embodiment, the +Z direction is an example of the "first direction", and the +Y direction is an example of the "third direction". The number of head chips 10 held in the holder 40 is not limited to four, and may be two or more. The arrangement of the plurality of head chips 10 is not limited thereto.

Figure 2:
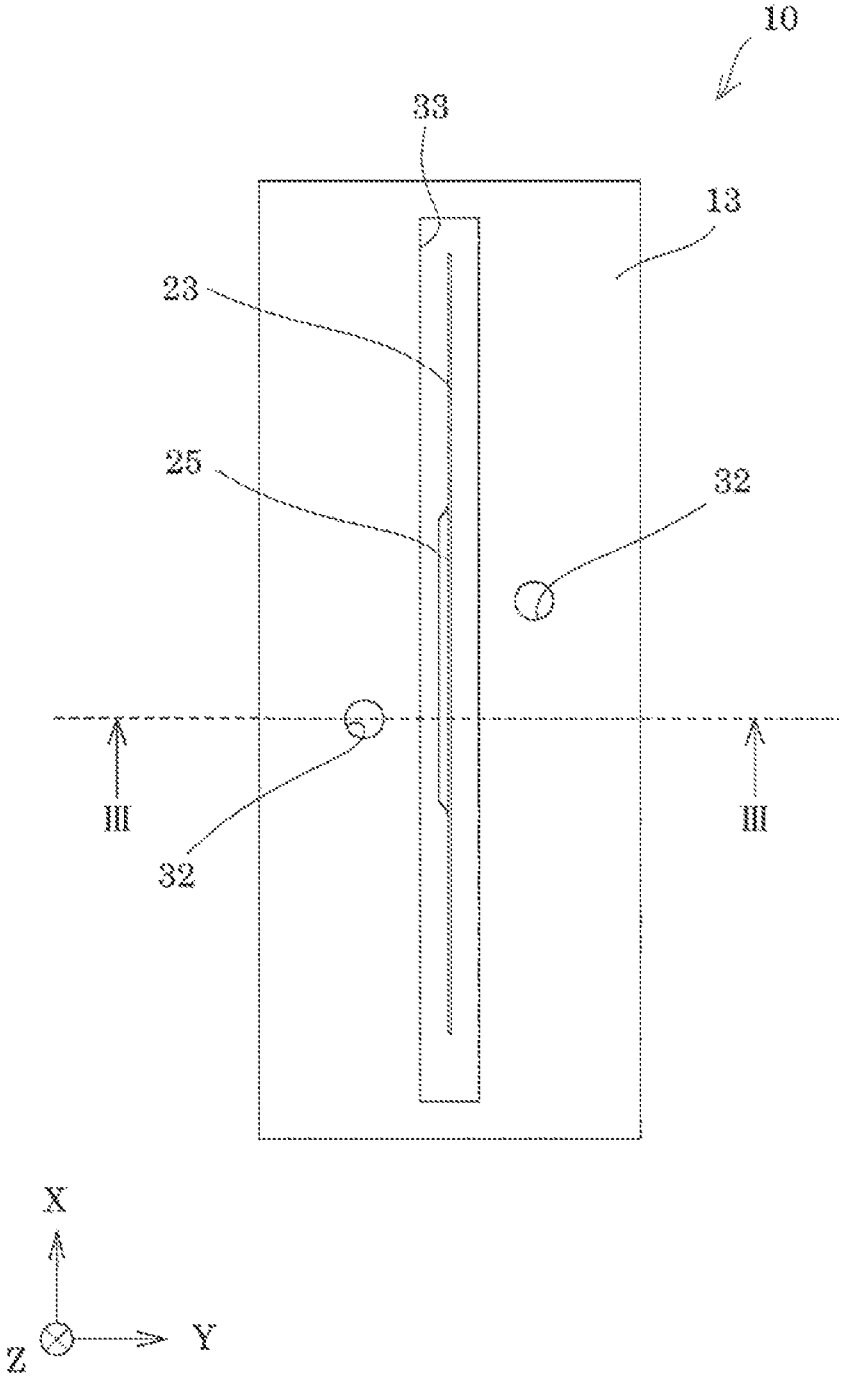
FIG. 2 is an upper view of a head chip according to Embodiment 1.
Figure 3:
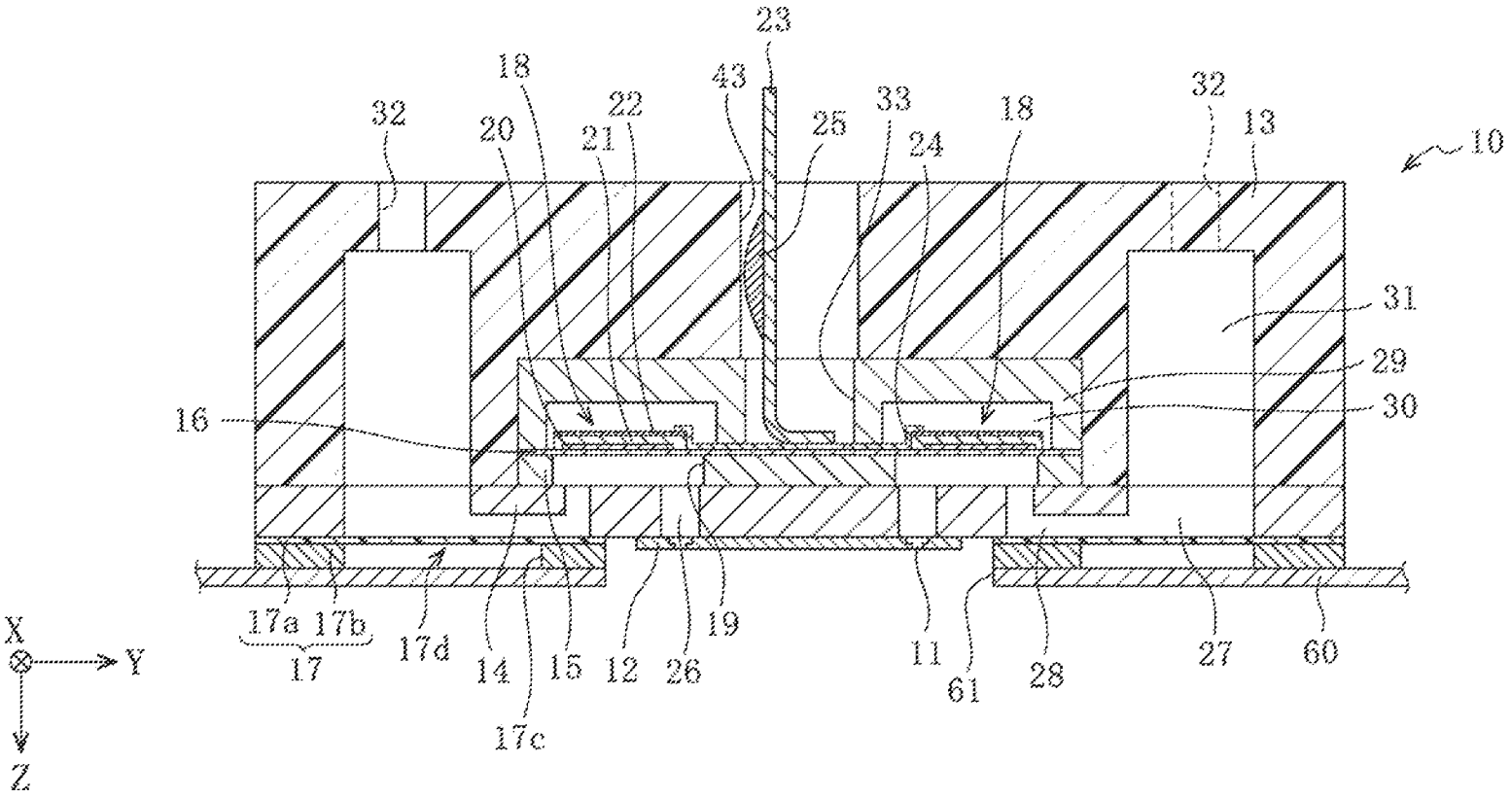
FIG. 3 is a sectional view of the head chip according to Embodiment 1.

Here, an example of the head chip 10 will be described with reference to FIGS. 2 to 3. FIG. 2 is a plan view of the head chip 10 when viewed in the +Z direction, and FIG. 3 is a sectional view taken along line III-III of FIG. 2. In the embodiment, each direction of the head chip 10 will be described based on the direction when the head chip 10 is mounted on the recording head 1.

As illustrated in FIGS. 2 and 3, the head chip 10 includes: a nozzle plate 12 provided with a plurality of nozzles 11 for discharging ink in the +Z direction; and a case 13 in which an introduction port 32 and an introduction liquid chamber 31 (will be described later) which are examples of a "first flow path" communicating with the plurality of nozzles 11 are formed. The head chip 10 of the embodiment further includes a communication plate 14, a pressure chamber forming substrate 15, a diaphragm 16, a compliance substrate 17, a piezoelectric actuator 18, and the like. The plurality of configuration members that configure these head chips 10 are laminated and joined by an adhesive or the like to form a unit.

The pressure chamber forming substrate 15 of the embodiment has a plurality of pressure chambers 19 communicating with each of the plurality of nozzles 11 formed on the nozzle plate 12. The plurality of piezoelectric actuators 18 are provided corresponding to each pressure chamber 19. The piezoelectric actuator 18 is an energy generating element that causes pressure fluctuation in the ink in the corresponding pressure chamber 19, that is, generation of energy required for ejecting ink from the nozzle 11 communicating with the pressure chamber 19, and is also a pressure generating element. The diaphragm 16 is provided between the pressure chamber 19 and the piezoelectric actuator 18, and the diaphragm 16 seals the opening of the pressure chamber 19 on the −Z direction side to partition a part of the pressure chamber 19. The pressure chamber forming substrate 15 and the diaphragm 16 may be integrally formed. The piezoelectric actuators 18 are laminated respectively in the regions corresponding to each of the pressure chambers 19 on the diaphragm 16. The piezoelectric actuator 18 of the embodiment is formed by sequentially laminating a first electrode 20, a piezoelectric layer 21, and a second electrode 22 on the diaphragm 16. The piezoelectric actuator 18 configured in this manner bends and deforms when an electric field corresponding to the potential difference between the first electrode 20 and the second electrode 22 is applied.

A flexible wiring substrate 23 is coupled to the piezoelectric actuator 18. In the embodiment, each electrode of the piezoelectric actuator 18 and the wiring substrate 23 are coupled to each other through a lead-out wiring 24 pulled out from the piezoelectric actuator 18 to the top of the diaphragm 16. A circuit substrate having a switching element such as a transmission gate for driving the piezoelectric actuator 18 and a driving circuit 25 such as a semiconductor integrated circuit (IC) are mounted on the wiring substrate 23. The wiring substrate 23 is pulled out in the −Z direction of the pressure chamber forming substrate 15.

The communication plate 14 having a larger area than that of the pressure chamber forming substrate 15 in a plan view when viewed in the +Z direction is joined to the surface of the pressure chamber forming substrate 15 on the +Z direction side. The communication plate 14 of the embodiment has a nozzle communication port 26 that communicates with the pressure chamber 19 and the nozzle 11, a common liquid chamber 27 commonly provided in each of the pressure chambers 19, and an individual communication port 28 that communicates with the common liquid chamber 27 and the pressure chamber 19. The common liquid chamber 27 is a space that extends along the ±X direction in which the nozzles 11 are arranged side by side. In the embodiment, two common liquid chambers 27 are formed respectively corresponding to the rows of the two nozzles 11 provided on the nozzle plate 12. A plurality of individual communication ports 28 are formed along the ±X direction, which is the nozzle row direction, respectively corresponding to each of the pressure chambers 19. The individual communication port 28 communicates with the end portion of the pressure chamber 19 opposite to the part that communicates with the nozzle communication port 26.

The nozzle plate 12 on which the plurality of nozzles 11 are formed is joined to a substantially central part of the surface of the communication plate 14 on the +Z direction side. The nozzle plate 12 in the embodiment is a plate material having an outer shape smaller than that of the communication plate 14 in a plan view when viewed in the −Z direction. The nozzle plate 12 is joined to the surface of the communication plate 14 on the +Z direction side by an adhesive or the like in a state where the nozzle communication port 26 and the plurality of nozzles 11 communicate with each other at a position deviated from the opening of the common liquid chamber 27, and in a region where the nozzle communication port 26 is opened. The nozzle plate 12 in the embodiment is formed with a total of two nozzle rows (not illustrated) in which the plurality of nozzles 11 are arranged side by side in the +X direction, which is the above-described nozzle row direction. The two nozzle rows are arranged side by side in the +Y direction.

The compliance substrate 17 is joined to the surface of the communication plate 14 on the +Z direction side at a position deviated from the nozzle plate 12. The compliance substrate 17 seals the opening of the common liquid chamber 27 on the surface of the communication plate 14 on the +Z direction side in a state of being positioned and joined to the surface of the communication plate 14 on the +Z direction side.

In the embodiment, the compliance substrate 17 includes a sealing film 17*a* including a thin film having flexibility such as resin, and a fixed substrate 17*b* including a hard material such as metal (for example, stainless steel). Since the region of the fixed substrate 17*b* facing the common liquid chamber 27 is a fixed substrate opening portion 17*c* completely removed in the thickness direction, one surface of the common liquid chamber 27 is a compliance portion 17*d*, which is a flexible portion sealed only by the flexible sealing film 17*a*. The compliance portion 17*d* flexibly deforms to have a function of alleviating the pressure fluctuation in the ink flow path, particularly in the common liquid chamber 27.

A protective substrate 29 having substantially the same size as that of the pressure chamber forming substrate 15 is joined in the −Z direction of the pressure chamber forming substrate 15. The protective substrate 29 has a holding portion 30 which is a space for protecting the piezoelectric actuator 18.

The pressure chamber forming substrate 15, the protective substrate 29, and the communication plate 14 are fixed to the case 13. Inside the case 13, the introduction liquid chambers 31 that communicate with the common liquid chamber 27 of the communication plate 14 are formed on both sides that sandwich the pressure chamber forming substrate 15 therebetween. The introduction ports 32 that communicate with each of the introduction liquid chambers 31 are respectively provided on the surface of the case 13 on the −Z direction side. The introduction port 32 communicates with a second flow path 50 provided in the holder 40, which will be described in detail later. Therefore, the ink sent from the holder 40 is introduced into the introduction port 32, the introduction liquid chamber 31, and the common liquid chamber 27, and is supplied from the common liquid chamber 27 to each of the pressure chambers 19 through the individual communication port 28. In the embodiment, the introduction port 32 and the introduction liquid chamber 31 provided in the case 13 correspond to the "first flow path" described in the claims. The protective substrate 29 and the case 13 are provided with a wiring insertion hole 33 through which the wiring substrate 23 is inserted. The wiring substrate 23 pulled out from the pressure chamber forming substrate 15 in the −Z direction is inserted through the protective substrate 29 and the wiring insertion hole 33 of the case 13 and is pulled out to the −Z direction side of the case 13.

In the embodiment, the case 13 includes resin. The resin that configures the case 13 may be, for example, a thermoplastic resin or a thermosetting resin. Examples of the thermoplastic resin include polyphenylene ether resin (PPE), modified polyphenylene ether resin (m-PPE), polyethylene resin (PE), polystyrene resin (PS), polyamide resin (PA), PPS, PP, LCP, ABS resin, vinyl chloride-vinyl acetate copolymer resin, polyvinyl chloride resins, and mixtures thereof. Examples of the thermosetting resin include phenolic resin such as bakelite, epoxy resin such as epoxy glass, urethane resin, melamine resin, and ester resin. It is preferable to use a thermosetting resin having excellent temperature stability, liquid resistance, and high rigidity for the case 13. By forming the case 13 with resin in this manner, the thermal conductivity can be lowered as compared with metal or the like. Therefore, it is possible to suppress a decrease in the temperature of the ink flowing through the introduction port 32 and the introduction liquid chamber 31, which are the first flow paths provided in the case 13, and to guide the ink of which the temperature decrease is suppressed to the nozzle 11. By forming the case 13 with resin, the cost can be reduced as compared with a case where the case 13 includes metal or ceramics. In particular, since one recording head 1 is provided with the plurality of head chips 10, the number of metal components or ceramic components used for the head chip 10 can be reduced by forming the case 13 with resin, and the cost can be reduced relatively significantly. It is needless to say that the case 13 includes a material other than resin, for example, metal or ceramics.

In the head chip 10 having the above-described configuration, in a state where the flow path from the introduction liquid chamber 31 to the nozzle 11 through the common liquid chamber 27 and the pressure chamber 19 is filled with ink, as the piezoelectric actuator 18 is driven, the pressure fluctuation occurs in the ink in the pressure chamber 19, and the ink is ejected from the predetermined nozzle 11 due to the pressure fluctuation.

The case 13 of the head chip 10 of the embodiment has two "first flow paths", the nozzle plate 12 of the embodiment has the plurality of nozzles 11 that configure two nozzle rows, the plurality of nozzles 11 that configure one nozzle row communicate with one "first flow path", the plurality of nozzles 11 that configure the other nozzle row communicate with the other "first flow path", but the disclosure is not limited to this aspect. The case 13 of the head chip 10 may have one or more "first flow paths", and the "first flow path" may communicate with at least a part of the plurality of nozzles 11 provided on the nozzle plate 12. The fact that the "first flow path" communicates with at least a part of the plurality of nozzles 11 provided on the nozzle plate 12 may mean that the "first flow path" is configured to communicate with all of the plurality of nozzles 11 provided on the nozzle plate 12, or may mean that the "first flow path" is configured to communicate with two or more nozzles 11 among the plurality of nozzles 11 provided on the nozzle plate 12.

As illustrated in FIG. 1, in the embodiment, the four head chips 10 are held in the holder 40 at predetermined intervals along the +Y direction in a posture in which the nozzle row direction is along the +X direction and in a state where the positions in the +X direction are the same. The +Y direction is an example of the "third direction".

The holder 40 fixes the plurality of, in the embodiment, four head chips 10 to the surface in the +Z direction, and is provided with the second flow path 50 that communicates with the introduction port 32 and the introduction liquid chamber 31, which are the "first flow paths" provided in the case 13 of the head chip 10.

Figure 4:
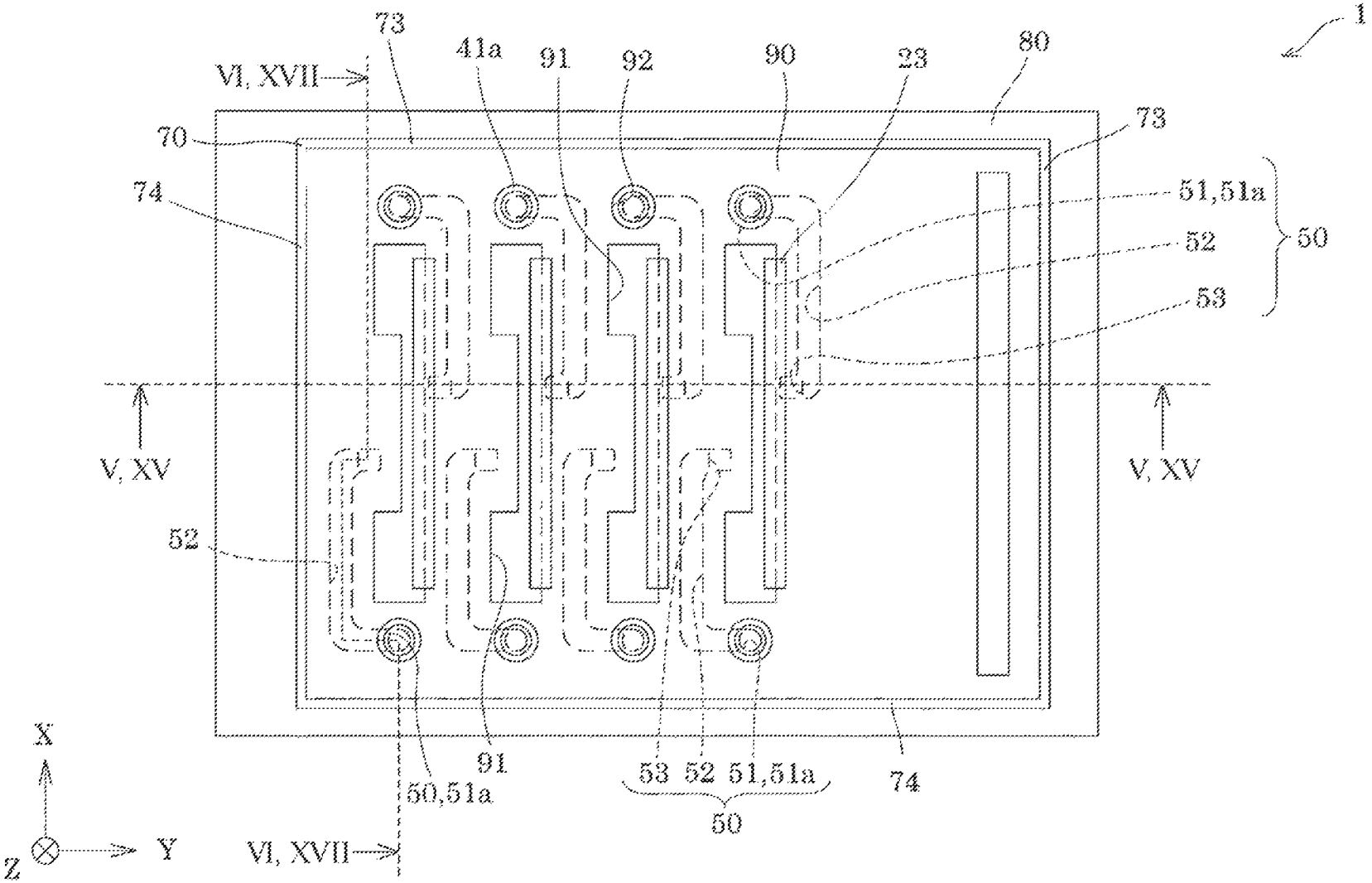
FIG. 4 is an upper view of the recording head according to Embodiment 1.
Figure 5:
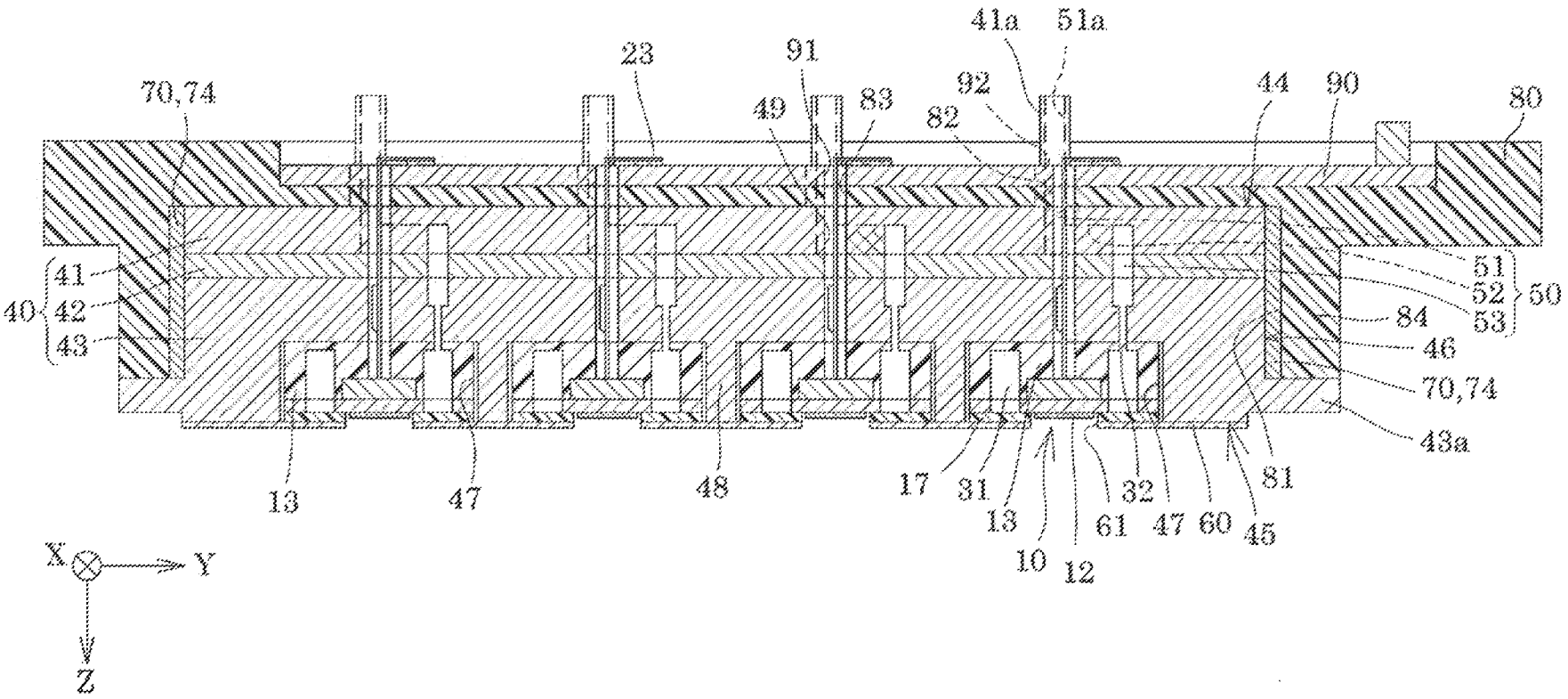
FIG. 5 is a sectional view of the recording head according to Embodiment 1.
Figure 6:
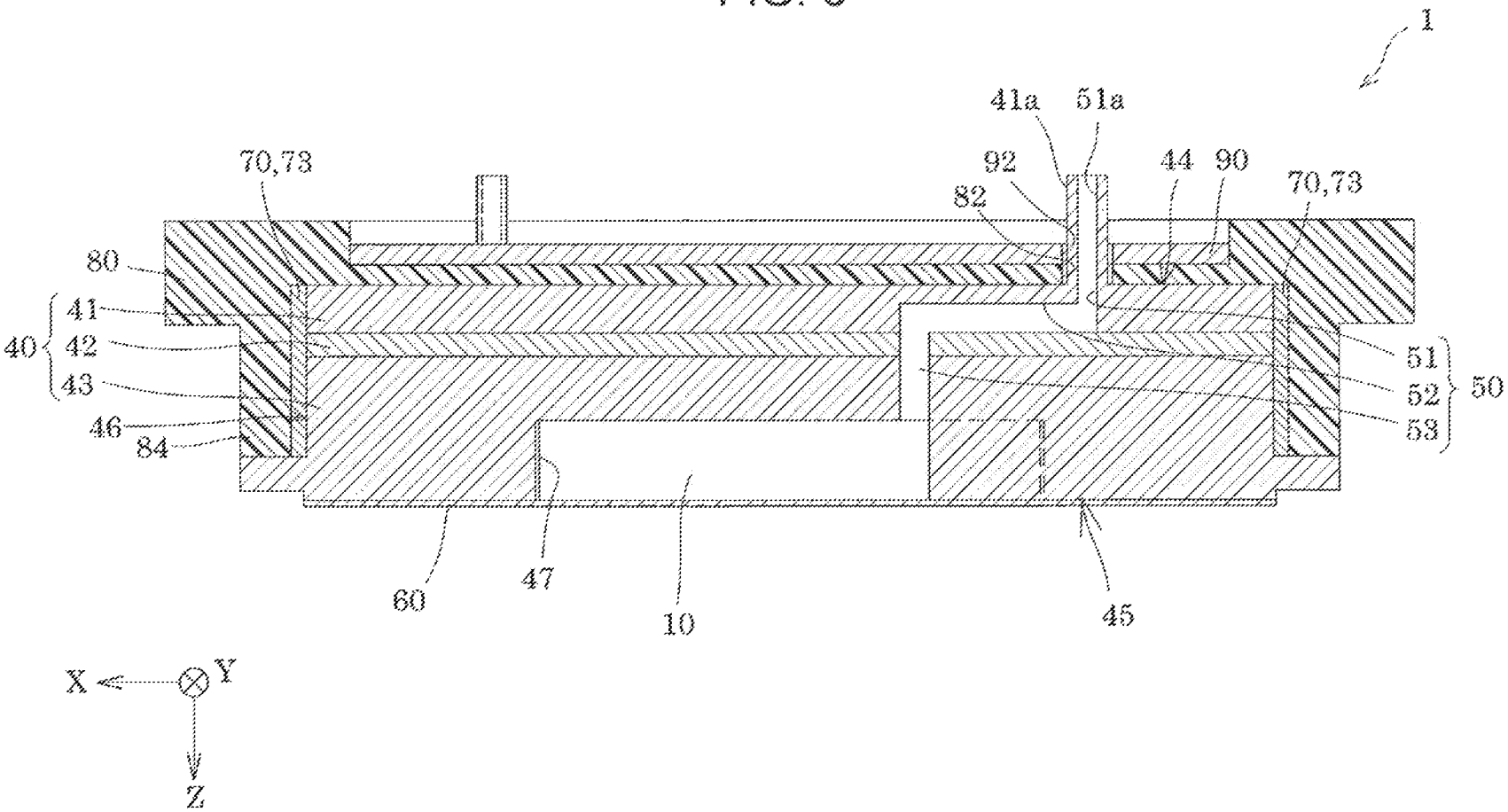
FIG. 6 is a sectional view of the recording head according to Embodiment 1.
Figure 7:
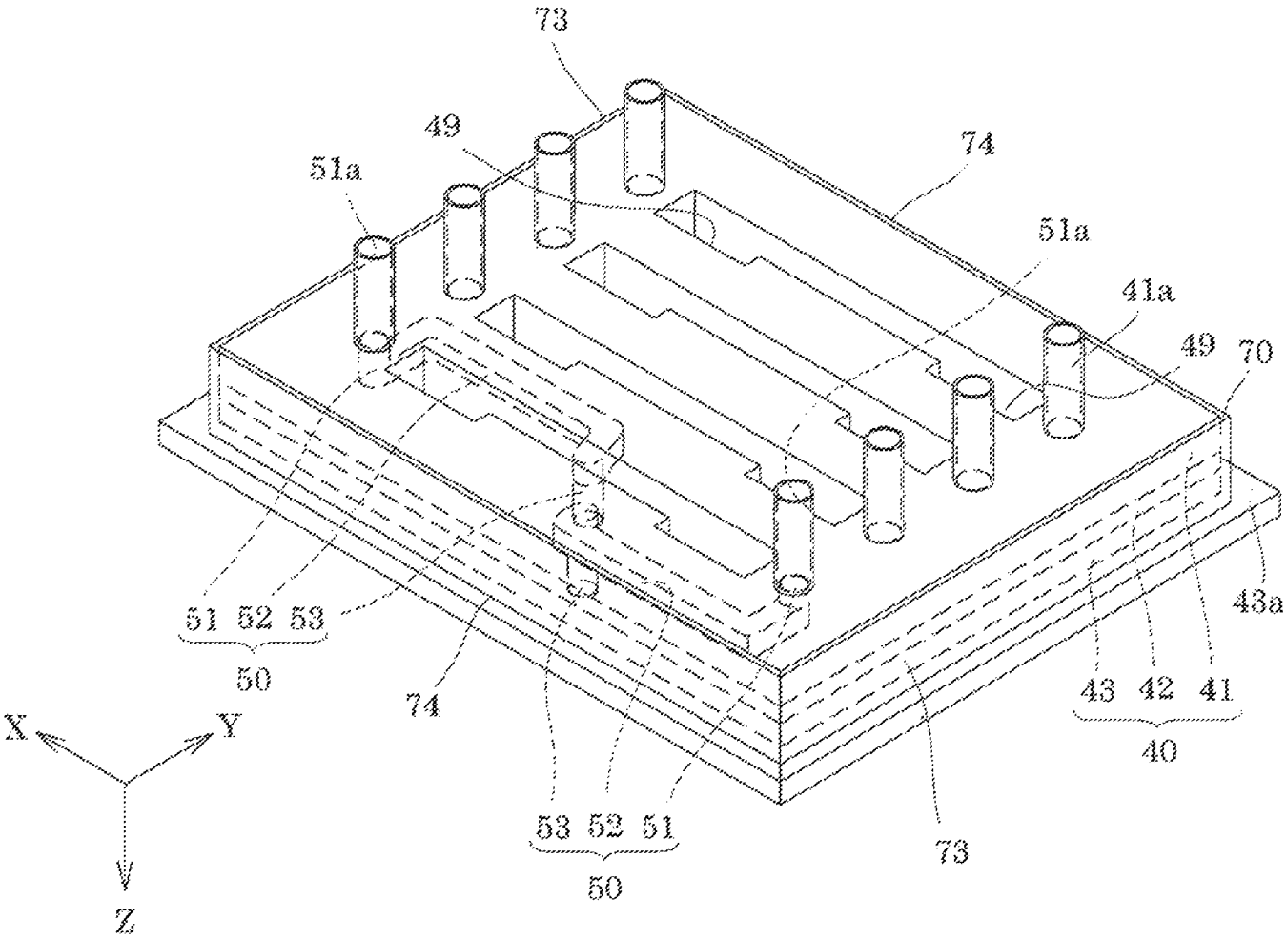
FIG. 7 is a perspective view of a holder and a heater according to Embodiment 1.
Figure 8:
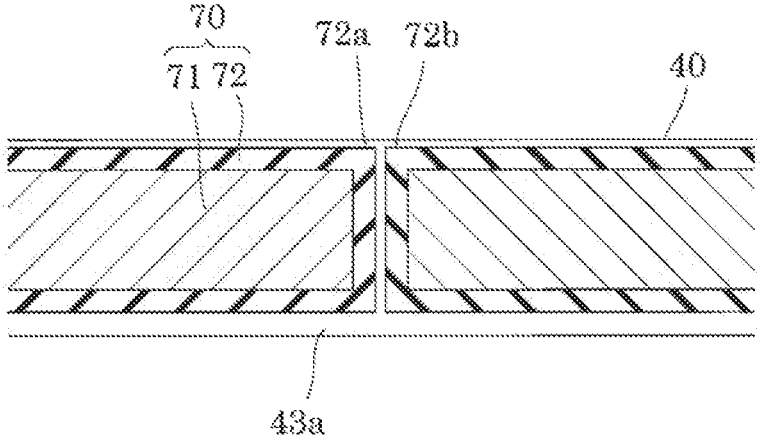
FIG. 8 is a side view of the holder and the heater according to Embodiment 1.
Figure 9:
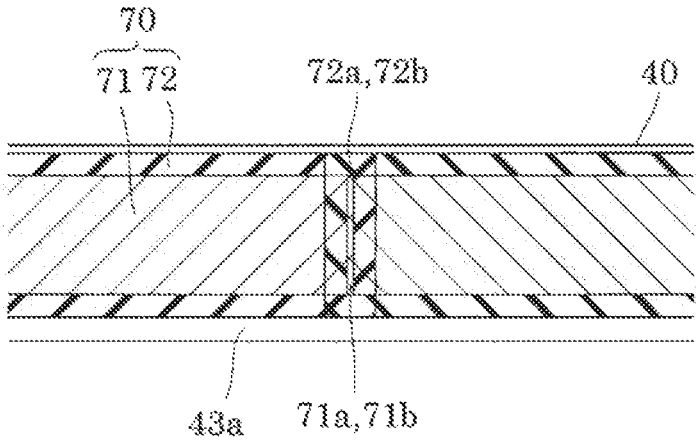
FIG. 9 is a side view of the holder and the heater according to Embodiment 1.
Figure 10:
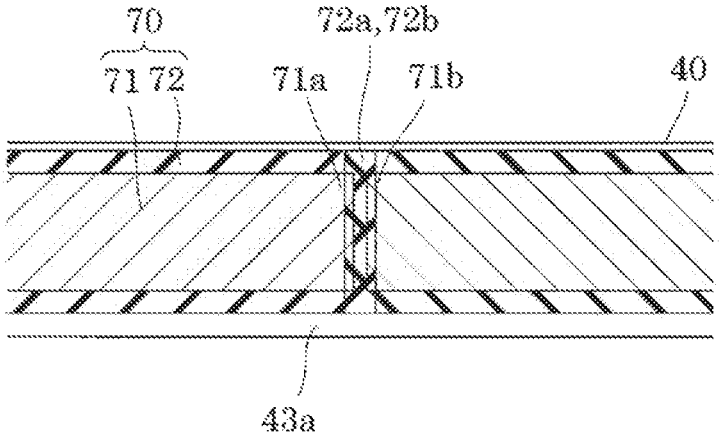
FIG. 10 is a side view of the holder and the heater according to Embodiment 1.

Here, the holder 40 will be further described with reference to FIGS. 4 to 10. FIG. 4 is an upper view of the recording head 1. FIG. 5 is a sectional view taken along the line V-V of FIG. 4. FIG. 6 is a sectional view taken along the line VI-VI of FIG. 4. FIG. 7 is a perspective view of the holder 40 and the heater 70, and is a view illustrating only two second flow paths 50 with respect to one head chip 10 by dotted lines. FIGS. 8 to 10 are side views of the holder 40 and the heater 70.

As illustrated in the drawings, in the holder 40 of the embodiment, a first member 41, a second member 42, and a third member 43 are laminated in this order in the +Z direction and joined to each other by an adhesive or the like. A method of fixing each member that configures the holder 40 is not limited to joining with an adhesive, and may be fastened with screws, bolts, or the like. A sealing material or the like for suppressing ink leakage from the second flow path 50 may be provided between each member that configures the holder 40.

The holder 40 is configured to include metal or ceramics. Here, the fact that the holder 40 includes metal or ceramics means that at least one of the plurality of members that configure the holder 40 includes metal or ceramics. In other words, when at least one of the plurality of members that configure the holder 40 includes metal or ceramics, the other members include a material other than metal and ceramics, for example, resin.

The fact that the holder 40 includes metal or ceramics means that at least a part of the members that configure the holder includes metal or ceramics. In other words, the entirety or a part of one of the plurality of members that configure the holder 40 includes metal or ceramics. That is, when at least a part of one of the plurality of members that configure the holder 40 includes metal or ceramics, the other part may include a material other than metal and ceramics, for example, resin. A member including metal or ceramics and a material other than metal or ceramics such as resin can be integrally manufactured by, for example, insert molding or the like.

The fact that the holder 40 includes metal or ceramics means that more than 80% of the volume of the holder 40 includes metal or ceramics.

Furthermore, the fact that the holder 40 includes metal or ceramics means that the part from at least a part of an outer peripheral wall 46 on which the heater 70 (will be described in detail later) is provided to a part that forms at least a part of the inner wall surface of the second flow path 50 includes metal or ceramics. In this manner, by forming the part from at least a part of the outer peripheral wall 46 on which the heater 70 of the holder 40 is provided to at least a part of the inner wall surface of the second flow path 50 with metal or ceramics, the heat of the heater 70 can be efficiently transmitted to the ink flowing in the second flow path 50.

In the embodiment, the first member 41, the second member 42, and the third member 43 that configure the holder 40 all include the same metal or ceramics. Here, examples of the metal that forms the holder 40 include materials having high liquid resistance, such as stainless steel and titanium. Examples of the ceramics that form the holder 40 include ceramics having excellent thermal conductivity such as aluminum nitride, silicon carbide, alumina, and silicon nitride. The thermal conductivity of the ceramics is 150 W/m·k for aluminum nitride, 60 W/m·k for silicon carbide, 32 W/m·k for alumina, and 20 W/m·k for silicon nitride. Therefore, by forming the holder 40 with the above-described ceramics, the thermal conductivity is made higher than that of metal, and the heat of the heater 70, which will be described in detail later, can be easily conducted to the ink in the second flow path 50. By forming the holder 40 with metal, the thermal conductivity is lower than that of ceramics, but the thermal conductivity can be increased as compared with resin, and it is relatively easy to process and the rigidity can be increased. It is preferable that the first member 41, the second member 42, and the third member 43 use materials having the same linear expansion coefficient. By using the same material for the first member 41, the second member 42, and the third member 43 in this manner, it is possible to suppress breakage such as peeling or cracks due to warpage caused by the difference in linear expansion coefficient. In particular, since the holder 40 is heated by the heater 70, which will be described in detail later, breakage such as peeling or cracks due to warpage is likely to occur due to the difference in linear expansion coefficient of each member that configures the holder 40. By using the same material for each member that configures the holder 40, even when the holder 40 is heated by the heater 70, it is possible to suppress breakage such as peeling or cracks due to warpage caused by the difference in linear expansion coefficient.

The first member 41 and the second member 42 have substantially the same outer shape in a plan view when viewed in the +Z direction. In the embodiment, the first member 41 and the second member 42 have a substantially rectangular shape in a plan view when viewed in the +Z direction. The shapes of the first member 41 and the second member 42 in a plan view when viewed in the +Z direction are not limited to a rectangular shape, and may be a polygonal shape, a circular shape, an elliptical shape, or the like.

The third member 43 is formed with an outer shape having substantially the same size as the first member 41 and the second member 42 on the +Z direction side in a plan view when viewed in the +Z direction. On the +Z direction side of the third member 43, a projection portion 43*a* that protrudes on the outside of the first member 41 and the second member 42 in a plan view when viewed in the +Z direction, that is, in the ±X and ±Y directions, is provided. By providing the projection portion 43*a* in this manner, the heater 70, which will be described in detail later, can be brought into contact with the surface of the projection portion 43*a* on the −Z direction side for positioning, and thus, the heater 70 can be easily positioned in the ±Z direction with respect to the holder 40.

Here, in the embodiment, the outer wall having the surface in the −Z direction opposite to the +Z direction of the holder 40 is referred to as an upper wall 44, the outer wall having the surface in the +Z direction which is the "first direction" is referred to as a lower wall 45, and the outer wall having a side surface coupling the upper wall 44 and the lower wall 45 to each other, that is, a side surface along the ±Z direction and including either the ±X direction or the ±Y direction and the ±Z direction is referred to as the outer peripheral wall 46. The −Z direction is an example of the "second direction".

The lower wall 45 of the third member 43 has a plurality of recess portions 47 that accommodate each of the head chips 10. The recess portion 47 is formed so as to be open on the lower wall 45, that is, be open on the surface in the +Z direction of the holder 40, and have substantially the same opening area in the −Z direction. In the embodiment, since the recess portions 47 for accommodating each of the head chips 10 are provided, a partition wall 48 configured with a part of the third member 43 is provided between the head chips 10 adjacent to each other in the +Y direction. In this manner, by providing the holder 40 with the recess portions 47 for accommodating each of the head chips 10, the rigidity of the holder 40 can be improved, and the landing position deviation or the like of the ink droplets discharged from each of the head chips 10 can be suppressed. Each head chip 10 is fixed to the bottom surface of each recess portion 47 with an adhesive or the like with a gap on the inner peripheral surface of each recess portion 47 of the holder 40. The bottom surface of the recess portion 47 refers to the surface of the recess portion 47 on the −Z direction side. As will be described in detail later, a common fixing plate 60 is fixed to the nozzle plate 12 side of the plurality of head chips 10. A part of the fixing plate 60 is fixed to the partition wall 48 between the recess portions 47 adjacent to each other. By fixing the fixing plate 60 with the partition wall 48 in this manner, the rigidity of the fixing plate 60 can further be improved, and the relative position deviation of the plurality of head chips 10 due to the deformation of the fixing plate 60 can be suppressed. It is needless to say that the recess portion 47 that accommodates the head chip 10 of the holder 40 is not limited thereto, and one recess portion 47 may accommodate two or more head chips 10.

The fixing plate 60 is fixed to the lower wall 45 including the partition wall 48 of the holder 40. The fixing plate 60 includes metal such as stainless steel or titanium. The fixing plate 60 is provided with a plurality of exposure opening portions 61 for exposing the nozzle plate 12 of the head chip 10. The exposure opening portion 61 of the embodiment is slightly larger than the nozzle plate 12 and smaller than the outer shape of the compliance substrate 17. Therefore, the exposure opening portion 61 is provided independently for each nozzle plate 12. The fixing plate 60 is also joined to the compliance substrate 17 of the head chip 10. It is needless to say that the exposure opening portion 61 may be provided in a size that exposes two or more nozzle plates 12.

Since the fixing plate 60 including such metal is fixed to the lower wall 45, the heat of the heater 70 fixed to the holder 40 can be transmitted to the "first flow path" in the head chip 10 through the lower wall 45, the fixing plate 60, and the compliance substrate 17. Furthermore, in the embodiment, since the partition wall 48 is provided between the head chips 10 adjacent to each other in the +Y direction as described above, even for the head chip 10 disposed away from the heater 70, the heat of the heater 70 can be transmitted to the "first flow path" in the head chip 10 through the partition wall 48, the fixing plate 60, and the compliance substrate 17. Therefore, the heater 70 can efficiently heat the plurality of head chips 10 through the fixing plate 60. By fixing the fixing plate 60 to the partition wall 48, the heat of the heater 70 can be transmitted to the center portion side within the plane including the ±X direction and the ±Y direction of the holder 40 through the lower wall 45, the fixing plate 60, and the partition wall 48, the entire holder 40 can be heated by the heater 70 with reduced bias, and it is possible to suppress variation in the heating temperature of the ink passing through the plurality of second flow paths 50.

The holder 40 is provided with the second flow path 50 that communicates with each of the introduction port 32 and the introduction liquid chamber 31, which are the "first flow paths" provided in the case 13 of the head chip 10. In the embodiment, since four head chips 10 having two independent "first flow paths" are fixed to the holder 40, the holder 40 is provided with a total of eight second flow paths 50. One end of the second flow path 50 is provided to be open on the surface in the +Z direction of the holder 40, in the embodiment, on the bottom surface of the recess portion 47, and the other end thereof is provided to be open on the surface of the holder 40 in the −Z direction. One end that is open on the bottom surface of the recess portion 47 of the second flow path 50 is coupled to the introduction port 32 that is a part of the "first flow path" provided in the case 13 of the head chip 10.

Here, each second flow path 50 of the embodiment includes a first part 51, a second part 52, and a third part 53. The first part 51 is provided so as to penetrate the first member 41 in the Z direction. The end portion of the first part 51 in the −Z direction is provided in a projection portion 41*a* that protrudes further in the −Z direction from the upper wall 44 of the holder 40. In other words, the end portion of the second flow path 50 in the −Z direction is provided so as to protrude from the upper wall 44 in the −Z direction. In the embodiment, a part provided in the projection portion 41*a* that protrudes in the −Z direction from the upper wall 44 of the first part 51 is referred to as a coupling part 51*a*. In the embodiment, the projection portion 41*a* is integrally and continuously provided with the first member 41. It is needless to say that the projection portion 41*a* may be fixed to the first member 41 as a separate body from the first member 41.

The second part 52 is provided between the first member 41 and the second member 42 along a direction intersecting the +Z direction, in the embodiment, along a plane including the ±X direction and the ±Y direction orthogonal to the +Z direction. In other words, in the embodiment, the second part 52 is an "intersection part" that extends in the direction intersecting the +Z direction, which is the "first direction". The second part 52 is disposed to be routed along the plane including the ±X direction and the ±Y direction such that one end portion thereof communicates with the end portion of the first part 51 in the +Z direction and the other end thereof communicates with the end portion of the third part 53 in the −Z direction. The second part 52 of the embodiment is formed by providing a recess portion on the surface of the first member 41 in the +Z direction and covering the opening of the recess portion with the second member 42. It is needless to say that the second part 52 may be formed by providing a recess portion on the surface of the second member 42 in the −Z direction and by covering the opening of the recess portion of the second member 42 with the first member 41, and may be formed by providing recess portions in both of the first member 41 and the second member 42 and by aligning the openings of the two recess portions with each other. In the embodiment, the second part 52, which is the "intersection part", is provided between the first member 41 and the second member 42, but the disclosure is not particularly limited thereto, and the "intersection part" may be provided between the second member 42 and the third member 43.

The third part 53 is provided so as to penetrate the second member 42 and the third member 43 in the +Z direction. The third part 53 is provided such that the end portion in the −Z direction communicates with the end portion of the second part 52. The end portion of the third part 53 in the +Z direction is provided to be open on the surface of the holder 40 in the +Z direction, that is, the bottom surface of the recess portion 47. In the embodiment, the third part 53 is a "communication part" that communicates with the introduction port 32 which is the "first flow path" provided in the case 13 of the head chip 10.

In other words, the first part 51 and the third part 53 that configure the second flow path 50 of the embodiment extend along the +Z direction, which is the "first direction", and the second part 52 that configures the second flow path 50 extends along the plane including the direction intersecting the +Z direction, in the embodiment, the ±X direction and the ±Y direction orthogonal to the +Z direction. By providing the second part 52 which is the "intersection part" in the second flow path 50 in this manner, the second flow path 50 can be routed in the direction intersecting the +Z direction, it is possible to suppress interference of the plurality of second flow paths 50 with each other in the holder 40, and it is also possible to suppress interference of the second flow path 50 with other openings or other members. By suppressing the interference of the second flow path 50, it is possible to suppress the increase in size of the holder 40.

The second flow path 50 is provided with the heater 70 for heating the ink flowing through the plurality of second flow paths 50 in the plurality of, in the embodiment, eight holders 40. Here, the heater 70 is not particularly limited, but in the embodiment, the heater 70 includes a flexible film heater. As illustrated in FIG. 8, the heater 70 including a film heater has a heat generating portion 71 and a film member 72 that covers the heat generating portion 71. Specifically, the film member 72 has a base film as a base material and a protective film as an insulator, and in the film heater, the base film, the heat generating portion 71, and the protective film are laminated in this order. The heat generating portion 71 of the heater 70 is, for example, a heating resistor including stainless steel, copper, tungsten, nickel alloy, aluminum foil, or the like. In the embodiment, stainless steel having high ink resistance is used as the heating resistor of the heat generating portion 71. As the base film and the protective film, those having insulating properties are preferable, and for example, polyimide, polyethylene terephthalate, polyethylene naphthalate and the like can be adopted. Instead of the protective film of the film member 72, a film-like solder resist having insulating properties may be used. As illustrated in FIG. 8, since the heat generating portion 71 is not provided at the end portion of the heater 70 which is a film heater, only the film member 72 exists.

The fact that the heater 70 is provided in the holder 40 means that the heater 70 is in direct contact with the holder 40. For example, another member including a material having high thermal conductivity may be provided between the holder 40 and the heater 70, but the heating efficiency of the heater 70 is lowered, the size of the holder 40 provided with the heater 70 increases, and the size of the recording head 1 increases. Therefore, it is preferable that the holder 40 and the heater 70 are in direct contact with each other.

The heater 70 of the embodiment surrounds the plurality of second flow paths 50 in a plan view when viewed in the +Z direction, and is provided so as to overlap at least a part of the second flow path 50 when viewed in the direction orthogonal to the +Z direction, that is, the in-plane direction including the ±X direction and the ±Y direction. In other words, the heater 70 may be disposed at a position where at least one of the first part 51, the second part 52, and the third part 53 that configure the second flow path 50 and at least a part of the heater 70 overlap each other when viewed in the in-plane direction including the ±X direction and the ±Y direction. By disposing the heater 70 so as to surround the plurality of second flow paths 50 in this manner, the heater 70 can effectively perform heating even for the second flow path 50 disposed away from the outer peripheral wall 46 of the holder 40. In other words, among the plurality of second flow paths 50, the second flow path 50 on the center side in the ±Y direction is away from the heaters 70 provided on the outer peripheral walls 46 on both sides of the holder 40 in the ±Y direction. However, by providing the heater 70 so as to surround the plurality of second flow paths 50, that is, by providing the heater 70 on the outer peripheral walls 46 on both sides of the holder 40 in the ±X direction, the heating can be performed by the heater 70 in which the second flow paths 50 disposed away from the outer peripheral wall 46 on both sides of the ±Y direction are provided on the outer peripheral walls 46 on both sides in the ±X direction. By disposing the heater 70 so as to surround the plurality of second flow paths 50, it is possible to suppress heat dissipation from the holder 40.

It is preferable that the heater 70 is disposed overlapping the second part 52 which is the "intersection part" and the third part 53 which is the "communication part" when viewed in a direction orthogonal to the +Z direction, that is, the in-plane direction including the ±X direction and the ±Y direction. In other words, the heater 70 may be disposed so as to overlap a part on a side that communicates with at least the third part 53 of the second part 52 and a part on a side that communicates with at least the second part 52 of the third part 53.

The flow path length of the second flow path 50 becomes longer by providing the second part 52, but the heater 70 can effectively heat the ink passing through the second part 52 by heating the second part 52 that lengthens the flow path length. Since the heater 70 extends in the +Z direction over the second part 52 and the third part 53, the length of the heater 70 in the +Z direction for heating the ink can be lengthened, and the ink can be effectively heated.

In other words, it is preferable that the heater 70 is disposed at a position overlapping the second part 52 when viewed in the direction orthogonal to the +Z direction, and it is more preferable that the heater 70 is disposed such that the length overlapping the second flow path 50 in the +Z direction is lengthened as long as possible.

The position of the heater 70 in the +Z direction with respect to the holder 40 of the embodiment is disposed such that the heater 70 overlaps the first part 51, the second part 52, and the third part 53 of the second flow path 50 of the holder 40. In other words, the heater of the embodiment completely is disposed so as to overlap the second part 52 when viewed in the in-plane direction including the ±X direction and the ±Y direction, and overlap the first part 51 and a part of the third part 53 on the side that communicates with the second part 52. Accordingly, the heater 70 can further heat the ink flowing through the first part 51 in addition to the second part 52 and the third part 53, and thus, the ink flowing through the second flow path 50 can be effectively heated.

The heater 70 including a film heater is wound so as to cover the outer peripheral wall 46 of the holder 40 in a plan view when viewed in the +Z direction, and is fixed to the outer peripheral wall 46. In other words, the heater 70 includes: a first part 73 that extends in the "third direction", which is the parallel direction of the head chips 10, that is, the +Y direction; and a second part 74 that extends in the direction intersecting the +Z direction and the +Y direction, in the embodiment, the +X direction orthogonal to the +Z direction and the +Y direction. The first part 73 is provided on the outer peripheral walls 46 on both sides of the outer peripheral wall 46 in the ±X direction. The second part 74 is provided on the outer peripheral walls 46 on both sides of the outer peripheral wall 46 in the ±Y direction. In this manner, the heater 70 can be easily attached to the holder 40 simply by winding the long flexible heater 70 around the outer peripheral wall 46 of the holder 40. By winding the heater 70 around the entire periphery of the outer peripheral wall 46 of the holder 40, heat dissipation of the holder 40 can be suppressed and the holder 40 can be efficiently heated by the heater 70.

A method of fixing the heater 70 to the outer peripheral wall 46 is not particularly limited, and the long flexible heater 70 may be simply wound around the outer peripheral wall 46, or the end portions of the heater 70 may be adhered to each other in a state where the heater 70 is wound around the outer peripheral wall 46. The heater 70 may be adhered to the outer peripheral wall 46 with an adhesive, or a part of the heater 70 may be welded to the outer peripheral wall 46. Furthermore, the heater 70 may be fixed to the outer peripheral wall 46 with screws, bolts or the like.

Here, both end portions of the heater 70 wound around the outer peripheral wall 46 of the holder 40 are disposed with a gap so as not to overlap each other as illustrated in FIG. 8. In other words, one end portion 72*a* and the other end portion 72*b* of the film member 72 of the heater 70 are disposed with a gap so as not to overlap each other. In this manner, as both end portions of the heater 70 are disposed on the outer peripheral wall 46 of the holder 40 with a gap so as not to overlap each other, it is possible to suppress an increase in thickness due to the overlap of both end portions of the heater 70, and to suppress an increase in size of the holder 40 around which the heater 70 is wound. In other words, the fact that the heater 70 is wound so as to cover the outer peripheral wall 46 of the holder 40 in a plan view when viewed in the +Z direction is not limited to a case where the heater 70 is continuously provided over the entire periphery of the outer peripheral wall 46 in a plan view when viewed in the +Z direction, and may mean a case where the heater 70 is wound so as to expose a part of the outer peripheral wall 46 of the holder 40. For example, the fact that the heater 70 is wound so as to cover the outer peripheral wall 46 of the holder 40 may mean that the heater 70 covers the entire periphery of the outer peripheral wall 46 by 75% or more. The fact that the heater 70 surrounds the plurality of second flow paths 50 means that the heater 70 surrounds the plurality of second flow paths 50 in three or more directions among the +X direction, the −X direction, the +Y direction, and the −Y direction in a plan view when viewed in the +Z direction.

As illustrated in FIG. 9, at both end portions of the heater 70 wound around the outer peripheral wall 46 of the holder 40, one end portion 71*a* and the other end portion 71*b* of the heat generating portion 71 may overlap each other. Accordingly, in a plan view when viewed in the +Z direction, the heat generating portion 71 can cover the outer peripheral wall 46 of the holder 40 over the entire periphery, and the holder 40 can be effectively heated.

Furthermore, as illustrated in FIG. 10, at both end portions of the heater 70 wound around the outer peripheral wall 46 of the holder 40, one end portion 71*a* and the other end portion 71*b* of the heat generating portion 71 may be disposed not to overlap each other, and one end portion 72*a* and the other end portion 72*b* of the film member 72 may be disposed to overlap each other. Accordingly, in a plan view when viewed in the +Z direction, the area where the heat generating portion 71 covers the outer peripheral wall 46 of the holder 40 can be increased, and it is possible to improve the heating efficiency of the holder 40, and to suppress an increase of outer periphery of the holder 40 around which the heater 70 is wound.

By providing the heater 70 in the holder 40 provided with the second flow path 50 in this manner, the ink passing through the second flow path 50 can be heated by the heater 70. In particular, in the embodiment, the heater 70 surrounds the plurality of second flow paths 50, and when viewed in the in-plane direction including the ±X direction and the ±Y direction, the heater 70 is disposed so as to overlap at least a part of the second flow path 50, and accordingly, the ink passing through the plurality of second flow paths 50 can be effectively heated by the heater 70.

The holder 40 is provided with a first wiring insertion hole 49 for pulling out the wiring substrate 23 of the head chip 10 fixed to the +Z direction side to the −Z direction side of the holder 40. The first wiring insertion holes 49 are provided independently in each of the wiring substrates 23. In other words, one end of the first wiring insertion hole 49 is provided to be open on the bottom surface of the recess portion 47, and the other end thereof is provided to be open on the surface of the holder 40 in the +Z direction. Therefore, the holder 40 is provided with a total of four first wiring insertion holes 49.

The holder 40 around which the heater 70 is wound on the outer peripheral wall 46 is covered with a holder cover 80.

The holder cover 80 has a recessed accommodation portion 81 that is open on the surface on the +Z direction side, and the holder 40 around which the heater 70 is wound is accommodated in the accommodation portion. The opening of the surface of the accommodation portion 81 on the +Z direction side is slightly larger than the outer shape of the holder 40 around which the heater 70 is wound, and is smaller than the projection portion 43*a* of the third member 43 of the holder 40. Therefore, when the accommodation portion 81 of the holder cover 80 accommodates the −Z direction side of the holder 40, the surface in the +Z direction on which the accommodation portion 81 of the holder cover 80 is open and the surface in the −Z direction of the projection portion 43*a* of the holder 40 are fixed to each other in a state of abutting against each other. A method of fixing the holder cover 80 and the holder 40 is not particularly limited, and may be adhered with an adhesive, or may be fixed with screws, bolts, or the like. Although not particularly illustrated, the holder cover 80 is provided with an opening for pulling out the wiring coupled to the heater 70 to the outside. The opening may be provided by opening on the surface of the holder cover 80 on the −Z direction side, or may be provided by opening on the side surface intersecting the +Z direction. It is needless to say that the wiring of the heater 70 may be pulled out from the opening of the accommodation portion 81 on the +Z direction side to the outside.

The holder cover 80 is provided with a first through hole 82 into which the projection portion 41*a* of the holder 40 is inserted so as to penetrate in the +Z direction. In other words, the first through hole 82 is provided so as to penetrate the bottom surface of the accommodation portion 81 and the surface of the holder cover 80 on the +Z direction side. In a state where the holder 40 is accommodated in the accommodation portion 81 of the holder cover 80, the projection portion 41*a* of the holder 40 is inserted through the first through hole 82 and protrudes toward the −Z direction side.

The holder cover 80 is provided with a second wiring insertion hole 83 penetrating in the +Z direction, which communicates with the first wiring insertion hole 49 of the holder 40. Therefore, the wiring substrate 23 of the head chip 10 fixed to the surface of the holder 40 in the +Z direction is pulled out to the −Z direction side of the holder cover 80 through the first wiring insertion hole 49 of the holder 40 and the second wiring insertion hole 83 of the holder cover 80.

A relay substrate 90 common to the plurality of wiring substrates 23 is held on the surface of the holder cover 80 in the −Z direction. The relay substrate 90 is provided with a third wiring insertion hole 91 that communicates with the second wiring insertion hole 83 of the holder cover 80. Therefore, the wiring substrate 23 of the head chip 10 is pulled out to the −Z direction side of the relay substrate 90 through the first wiring insertion hole 49 of the holder 40, the second wiring insertion hole 83 of the holder cover 80, and the third wiring insertion hole 91 of the relay substrate 90, and is coupled to the relay substrate 90 on the surface of the relay substrate 90 on the −Z direction side.

The relay substrate 90 is provided with a second through hole 92 penetrating in the +Z direction, which communicates with the first through hole 82 of the holder cover 80. Therefore, the projection portion 41*a* of the holder 40 is provided so as to protrude from the relay substrate 90 in the −Z direction through the first through hole 82 of the holder cover 80 and the second through hole 92 of the relay substrate 90. Ink from the outside is supplied to the opening of the second flow path 50 of the projection portion 41*a* provided so as to protrude in the −Z direction from the relay substrate 90, that is, the opening of the coupling part 51*a*. The projection portion 41*a* in the embodiment is a flow path pipe in which a part (coupling part 51*a*) of the second flow path 50 is formed inside, but may be a flow path needle having a sharp distal end on the −Z direction side.

The holder cover 80 is provided with a head outer wall 84 disposed so as to sandwich the heater 70 with the holder 40. In other words, the head outer wall 84 is a part outside the accommodation portion 81 that defines the inner surface of the accommodation portion 81 in the direction orthogonal to the +Z direction. The head outer wall 84 includes a material having a lower thermal conductivity than that of the holder 40, for example, resin. In the embodiment, the entire holder cover 80 includes a material having a lower thermal conductivity than that of the holder 40, for example, resin. It is needless to say that the disclosure is not limited thereto, and at least the head outer wall 84 of the holder cover 80 may be formed of a material having a lower thermal conductivity than that of the holder 40, and other parts may be formed of a different material. As the resin used for the head outer wall 84 of the holder cover 80, for example, the same resin as the case 13 can be used. In this manner, by forming the head outer wall 84 with a material having a lower thermal conductivity than that of the holder 40, it is possible to suppress dissipation of the heat of the heater 70 and the heat of the holder 40 heated by the heater 70 through the head outer wall 84. In the embodiment, by forming the entire holder cover 80 with a material having a lower thermal conductivity than that of the holder 40, it is possible to further suppress dissipation of heat of the heater 70 and the holder 40. Therefore, it is not necessary to overheat the heater 70, and the temperature of the ink flowing through the second flow path 50 can be easily managed by controlling the temperature of the heater 70.

On the other hand, when the thermal conductivity of the head outer wall 84 is the same as that of the holder 40 or higher than that of the holder 40, the heat of the heater 70 and the heat of the holder 40 heated by the heater 70 are dissipated from the head outer wall 84. In other words, the outside temperature of the head outer wall 84 opposite to the accommodation portion 81, for example, the temperature of the holding member such as the carriage that holds the holder cover 80 or the ambient temperature easily affects the heater 70 and the holder 40, and problems such as overheating of the heater 70 or frequent temperature control of the heater 70 are likely to occur.

As described above, in the recording head 1 which is the liquid ejecting head of the embodiment, the plurality of head chips 10 having the nozzle plate 12 having the plurality of nozzles 11 for ejecting ink which is a liquid in the +Z direction which is the "first direction", and the case 13 in which the introduction port 32 and the introduction liquid chamber 31 which are one or more "first flow paths" communicating with at least a part of the plurality of nozzles 11 are formed; the holder 40 to which the plurality of head chips 10 are fixed, which includes metal or ceramics, and which has the plurality of second flow paths 50 communicating with at least one of the plurality of introduction ports 32 and the introduction liquid chambers 31; and the heater 70 that heats the holder 40. In the embodiment, the case 13 is formed with two introduction ports 32 and two introduction liquid chambers 31, which are the "first flow paths" that communicate with the plurality of nozzles 11. The holder 40 is provided with the second flow path 50 that communicates with each of the plurality of introduction ports 32 and the introduction liquid chambers 31.

In this manner, since the second flow path 50 disposed in the vicinity of the head chip 10 can be heated by the heater 70, sufficiently heated ink can be supplied to the head chip 10. Since the holder 40 heated by the heater 70 includes metal or ceramics having high thermal conductivity, the heater 70 can sufficiently heat the ink flowing through the plurality of second flow paths 50 and sufficiently heated ink can also be supplied to the head chip 10 disposed at the position away from the heater 70. Therefore, it is possible to reduce the viscosity of the ink discharged from the head chip 10 and suppress the deterioration of the ink discharge characteristics. Furthermore, since the heater 70 is not configured to heat the head chip 10 itself, it is possible to simplify the routing of the wiring coupled to the heater 70 and the configuration of the recording head 1.

In the recording head 1 of the embodiment, it is preferable that the case 13 includes resin. By forming the case 13 with resin having a low thermal conductivity in this manner, it is possible to suppress the temperature decrease of the ink in the introduction port 32 and the introduction liquid chamber 31 which are the "first flow paths" of the case 13 disposed in the vicinity of the nozzle 11. Therefore, the introduction port 32 and the introduction liquid chamber 31 can guide the ink of which the temperature decrease is suppressed to the nozzle 11, and the ink of which the ink viscosity is decreased can be discharged from the nozzle 11.

In the recording head 1 of the embodiment, it is preferable that the heater 70 surrounds the plurality of second flow paths 50 in a plan view when viewed in the +Z direction which is the "first direction", and overlaps at least a part of the second flow path 50 when viewed in the direction orthogonal to the +Z direction, that is, the in-plane direction including the ±X direction and the ±Y direction. According to this, since the heater 70 is disposed so as to surround the plurality of second flow paths 50, the heater 70 can effectively perform heating even for the second flow path 50 disposed away from the outer peripheral wall 46 of the holder 40. By disposing the heater 70 so as to surround the plurality of second flow paths 50, it is possible to suppress heat dissipation from the holder 40.

In the recording head 1 of the embodiment, it is preferable that the second flow path 50 includes the second part 52 which is the "intersection part" that extends in a direction intersecting the +Z direction which is the "first direction", and the third part 53 which is the "communication part" that extends in the +Z direction and brings the second part 52 into communication with the introduction port 32 and the introduction liquid chamber 31 which are the "first flow path" of the case 13, and the heater 70 is disposed so as to overlap the second part 52 and the third part 53 when viewed in a direction orthogonal to the +Z direction. By providing the second part 52, which is the intersection part, in the second flow path 50 in this manner, the flow path length of the second flow path 50 can be lengthened, and the heater 70 can effectively heat the ink flowing through the second flow path 50. Since the heater 70 extends in the +Z direction over the second flow path 50 which is the "intersection part" and the third part 53 which is the "communication part", the heater 70 can effectively heat the ink flowing through the second flow path 50.

In the embodiment, in each of the plurality of second flow paths 50, the second part 52 which is the "intersection part" and the third part 53 which is the "communication part" are provided one by one, but the disclosure is not particularly limited thereto, and by providing the plurality of second parts 52 which are the "intersection parts" in the second flow path 50, the second flow path 50 may communicate with two or more "first flow paths". In other words, the second flow path 50 may be a branch flow path for distributing the liquid to two or more "first flow paths". In other words, the number of second flow paths 50 does not necessarily have a one-to-one correspondence with the number of "first flow paths" as described in the embodiment, and the holder 40 may include the plurality of second flow paths 50 that communicate with at least one "first flow path" among the plurality of "first flow paths" included in the plurality of head chips 10 fixed to the holder 40.

In the recording head 1 of the embodiment, it is preferable that the holder 40 has the outer peripheral wall 46 that surrounds the plurality of second flow paths 50 in a plan view when viewed in the +Z direction which is the "first direction", and the heater 70 is a film heater having flexibility, which is wound so as to cover the entire periphery of the outer peripheral wall 46 in a plan view when viewed in the +Z direction and is fixed to the outer peripheral wall 46. In this manner, the heater 70 can be easily attached to the holder 40 simply by winding the long flexible heater 70 around the outer peripheral wall 46 of the holder 40. Since the heater 70 is wound around the entire periphery of the outer peripheral wall 46, the heat dissipation of the holder 40 can be suppressed and the holder 40 can be efficiently heated by the heater 70. The heater 70 may be provided so as to cover the outer peripheral wall 46 in the +Z direction, or may be provided so as to cover only a part of the outer peripheral wall 46 in the +Z direction.

In the recording head 1 of the embodiment, it is preferable that the fixing plate 60 which has the plurality of exposure opening portions 61 which are the openings for exposing the plurality of nozzles 11 of the head chip 10, and includes metal, the holder 40 has the lower wall 45 to which the plurality of head chips 10 and the fixing plate 60 are fixed, and the lower wall 45 has the plurality of recess portions 47 for accommodating each of the plurality of head chips 10. In other words, since the holder 40 is provided with the recess portion 47 corresponding to each of the plurality of head chips 10, the partition wall 48 of the holder 40 is provided between the head chips 10 adjacent to each other. Therefore, the rigidity of the holder 40 can be improved, and the deformation of the fixing plate 60 can be suppressed. By forming the fixing plate 60 with metal, the heat of the heater 70 can be transmitted through the lower wall 45 including the partition wall 48 to which the fixing plate 60 is fixed, and it is possible to efficiently heat the holder 40, and to efficiently heat the plurality of head chips 10.

In this manner, in the embodiment, since the ink supplied to the head chip 10 can be heated by the heater 70 in the second flow path 50, as the ink used for the recording head 1, the ultraviolet curable type ink or the solvent-based ink can be used. In other words, the ultraviolet curable type ink or the solvent-based ink has a relatively high viscosity at room temperature, but the viscosity can be lowered by heating the highly viscous ink with the heater 70, and thus, the deterioration of the ink droplet discharge characteristics can be suppressed.

The solvent-based ink is ink in which the main component of the solvent is an organic solvent, and is also called solvent ink or non-aqueous ink. The solvent-based ink is ink containing any one or more of glycol ethers, glycol ether esters, dibasic acid esters, ester-based solvents, hydrocarbon-based solvents, and alcohol-based solvents. The ultraviolet curable type ink is, for example, UV ink containing a monomer or an oligomer that is cured by causing a polymerization reaction by irradiation with ultraviolet rays. Examples of the composition of the ultraviolet curable type ink include inks containing any one of (meth)acrylates, (meth)acrylamides, and N-vinyl compounds as a polymerizable compound.

In the recording head 1 of the embodiment, it is preferable that the head outer wall 84 disposed so as to sandwich the heater 70 with the holder 40 is further provided, and the head outer wall 84 has a lower thermal conductivity than that of the holder 40. According to this, by forming the head outer wall 84 with a material having a lower thermal conductivity than that of the holder 40, it is possible to suppress dissipation of the heat of the heater 70 and the heat of the holder 40 heated by the heater 70 through the head outer wall 84. Therefore, it is not necessary to overheat the heater 70, it is possible to suppress a decrease in the life of the components that configure the recording head 1, and the temperature of the ink flowing through the second flow path 50 can be easily managed by controlling the temperature of the heater 70.

In Embodiment 1 described above, the calorific value of the heater 70 is the same over the peripheral direction of the outer peripheral wall 46, but the disclosure is not particularly limited. For example, the calorific value per unit area of the first part 73 of the heater 70 may be larger than the calorific value per unit area of the second part 74. The calorific value per unit area of the first part 73 and the second part 74 of the heater 70 can be adjusted by changing, for example, the width of the heater pattern (wiring) of the heating resistor of the heat generating portion 71 or the density per unit area where the heating resistor is provided. Specifically, as the width of the heater pattern of the heating resistor of the heat generating portion 71 becomes narrower, the calorific value per unit area increases, and the density of the heating resistor becomes higher, the calorific value per unit area increases.

In other words, the plurality of head chips 10 are disposed side by side in the +Y direction which is the "third direction" orthogonal to the +Z direction which is the "first direction", the heater 70 includes the first part 73 that extends in the +Y direction, and the second part 74 that extends in the direction orthogonal to the +Z direction and intersecting the +Y direction, and the calorific value per unit area of the first part 73 is greater than the calorific value per unit area of the second part 74. Here, it is preferable that the parallel direction of the plurality of second flow paths 50 matches the parallel direction of the plurality of head chips 10. Accordingly, it is possible to simplify the structure by making it easy to handle the second flow path 50, to suppress the variation in the flow path length of the plurality of second flow paths 50, and to suppress variation in the ink droplets discharge characteristics between the plurality of head chips 10. In this manner, when the plurality of second flow paths 50 are arranged side by side in the +Y direction, the variation occurs in the distance from the outer peripheral walls 46 on both sides in the ±Y direction of the holder 40 between the plurality of second flow paths 50. On the other hand, when the plurality of second flow paths 50 are arranged side by side in the +Y direction, the variation in the distance from the outer peripheral walls 46 on both sides in the ±X direction of the holder 40 is relatively small. In other words, the plurality of second flow paths 50 have a large variation in the distance in the +Y direction from the second part 74 of the heater 70, and a small variation in the distance in the +X direction from the first part 73. Therefore, by making the calorific value of the first part 73 larger than the calorific value of the second part 74, it is possible to reduce the variation in the heating temperature of the plurality of second flow paths 50 in the holder 40, and to reduce the heating temperature variation of the ink flowing through the plurality of second flow paths 50. In other words, in the ±Y direction, which is the parallel direction of the head chips 10, the ink in the second flow path 50 that supplies the ink to the head chips 10 disposed on the center side is difficult to be heated, but by increasing the calorific value of the first part 73 that extends in the +Y direction, it is possible to easily heat the ink in the second flow path 50 that supplies the ink to the head chip 10 disposed on the center side. Therefore, it is possible to reduce the variation in the heating temperature of the plurality of second flow paths 50 in the holder 40.

In other words, the plurality of second flow paths 50 are disposed side by side in the +Y direction which is the "third direction" orthogonal to the +Z direction which is the "first direction", the heater 70 includes the first part 73 that extends in the +Y direction, and the second part 74 that extends in the direction orthogonal to the +Z direction and intersecting the +Y direction, and the calorific value per unit area of the first part 73 is greater than the calorific value per unit area of the second part 74. Accordingly, it is possible to reduce the variation in the heating temperature of the plurality of second flow paths 50 in the holder 40. In the embodiment, four second flow paths 50 are arranged in the +Y direction and two second flow paths 50 are arranged in the +Y direction, and accordingly, a total of eight second flow paths 50 are provided. However, the direction in which the second flow paths 50 are disposed side by side is the direction in which a large number of second flow paths 50 are arranged, that is, the +Y direction in the embodiment. Accordingly, by increasing the calorific value of the first part 73 that extends in the direction in which a large number of second flow paths 50 are arranged to be larger than the calorific value of the second part 74 that extends in the direction in which a small number of second flow paths 50 are arranged, it is possible to reduce the heating temperature variation of the ink flowing through the plurality of second flow paths 50.

Figure 11:
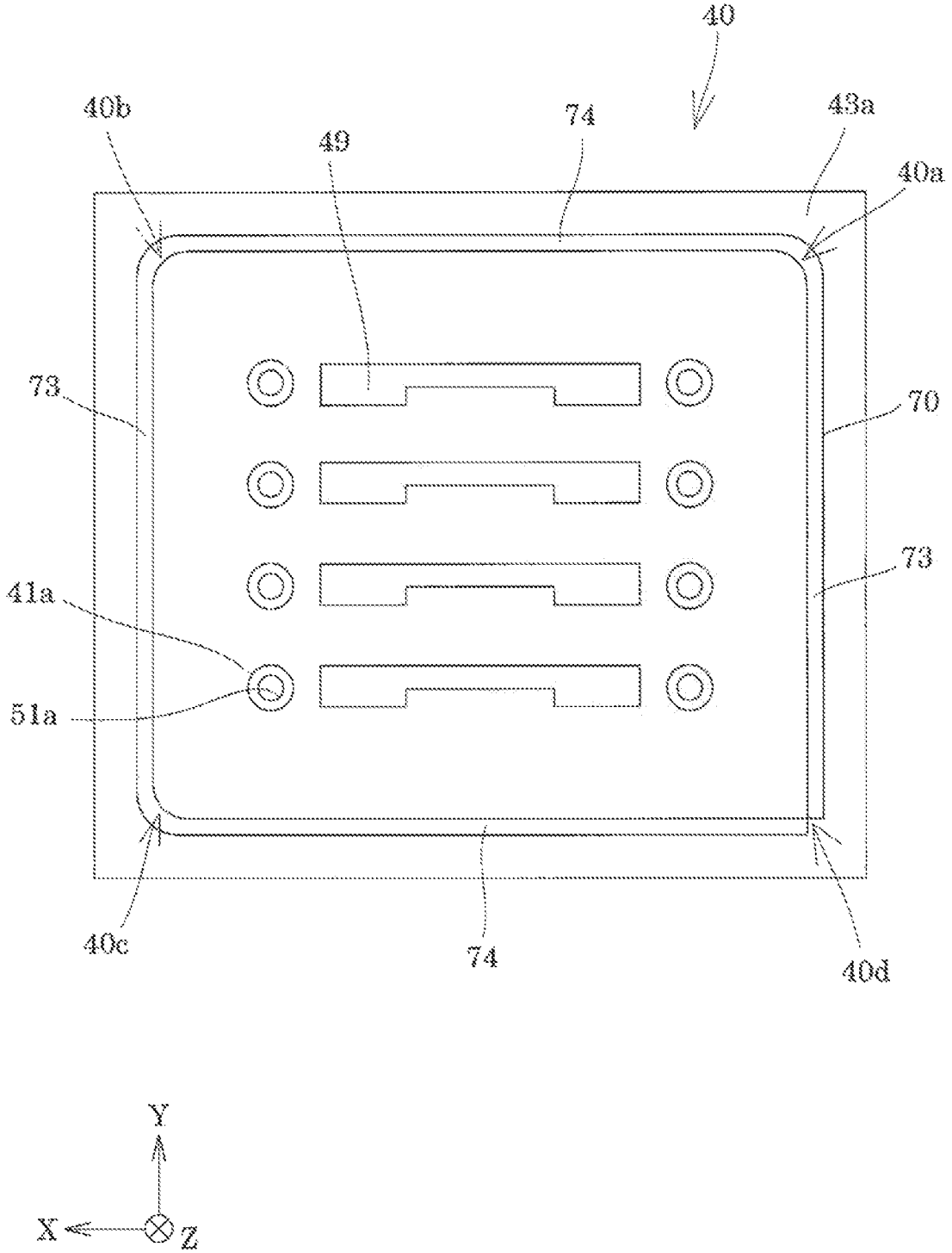
FIG. 11 is an upper view illustrating a modification example of the holder and the heater according to Embodiment 1.

In the embodiment, the holder 40 has a rectangular shape in a plan view when viewed in the +Z direction, but the disclosure is not particularly limited thereto, and the holder 40 may have a shape with rounded corners while a rectangular shape is a basic shape in a plan view when viewed in the +Z direction. Here, a modification example of the holder 40 is illustrated in FIG. 11. FIG. 11 is an upper view illustrating a modification example of the holder 40 and the heater 70.

As illustrated in FIG. 11, in the holder 40, in a plan view when viewed in the +Z direction, among four corner portions 40*a* to 40*d*, three corner portions 40*a* to 40*c* are curved surfaces that are chamfered and rounded to have a curvature, a so-called R surface, and one corner portion 40*d* is a right angle that is not chamfered.

In order to wind the heater 70 around the outer peripheral wall 46 of the holder 40, both end portions of the heater 70 may be brought together at the corner portion 40*d* that is not chamfered. Accordingly, since the heater 70 is curved along the curved surface at the corner portions 40*a* to 40*c*, it is possible to suppress the bending, and to suppress breakage of the heat generating portion 71 and peeling of the holder 40 from the outer peripheral wall 46. By aligning both end portions of the heater 70 with the corner portion 40*d*, the heater 70 can be disposed over the entire periphery of the outer peripheral wall 46 of the heater 70, both end portions of the heater 70 can reduce the stress applied in the direction of peeling from the holder 40, and the peeling of the heater 70 from the holder 40 can be suppressed. Incidentally, when both end portions of the heater 70 are aligned on the sides of the outer peripheral wall 46 along the ±X direction or ±Y direction, the distance to both end portions of the heater 70 from the part bent by the corner portions 40*a* to 40*d* of the heater 70 is shortened. Therefore, a force that resists bending of the heater 70 is applied to both end portions of the heater 70 as a reaction force that peels off both end portions from the holder 40, and both end portions of the heater 70 are easily peeled off from the holder 40. At the corner portion 40*d*, by disposing both end portions of the heater 70, as compared with a case where both end portions are aligned on the sides along the ±X direction or ±Y direction of the outer peripheral wall 46, both end portions of the heater 70 can be kept away from the second flow path 50, and thus, the heater 70 can effectively heat the plurality of second flow paths 50.

By making the corner portions 40*a* to 40*c* of the holder 40 an R surface, the total length of the heater 70 wound around the outer peripheral wall 46 can be shortened, and the cost can be reduced.

Figure 12:
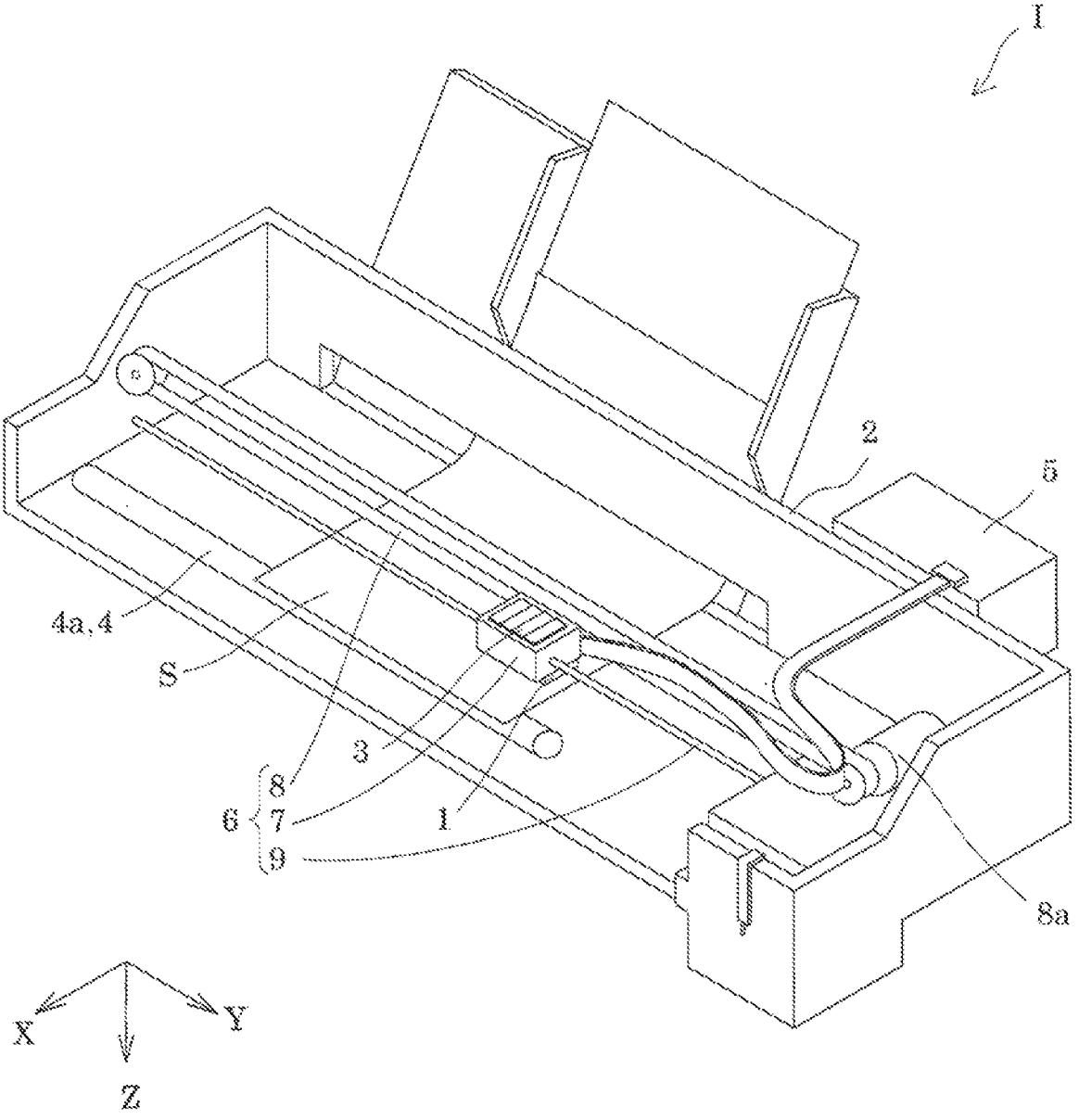
FIG. 12 is a view illustrating a schematic configuration of a recording apparatus according to Embodiment 1.
Figure 13:
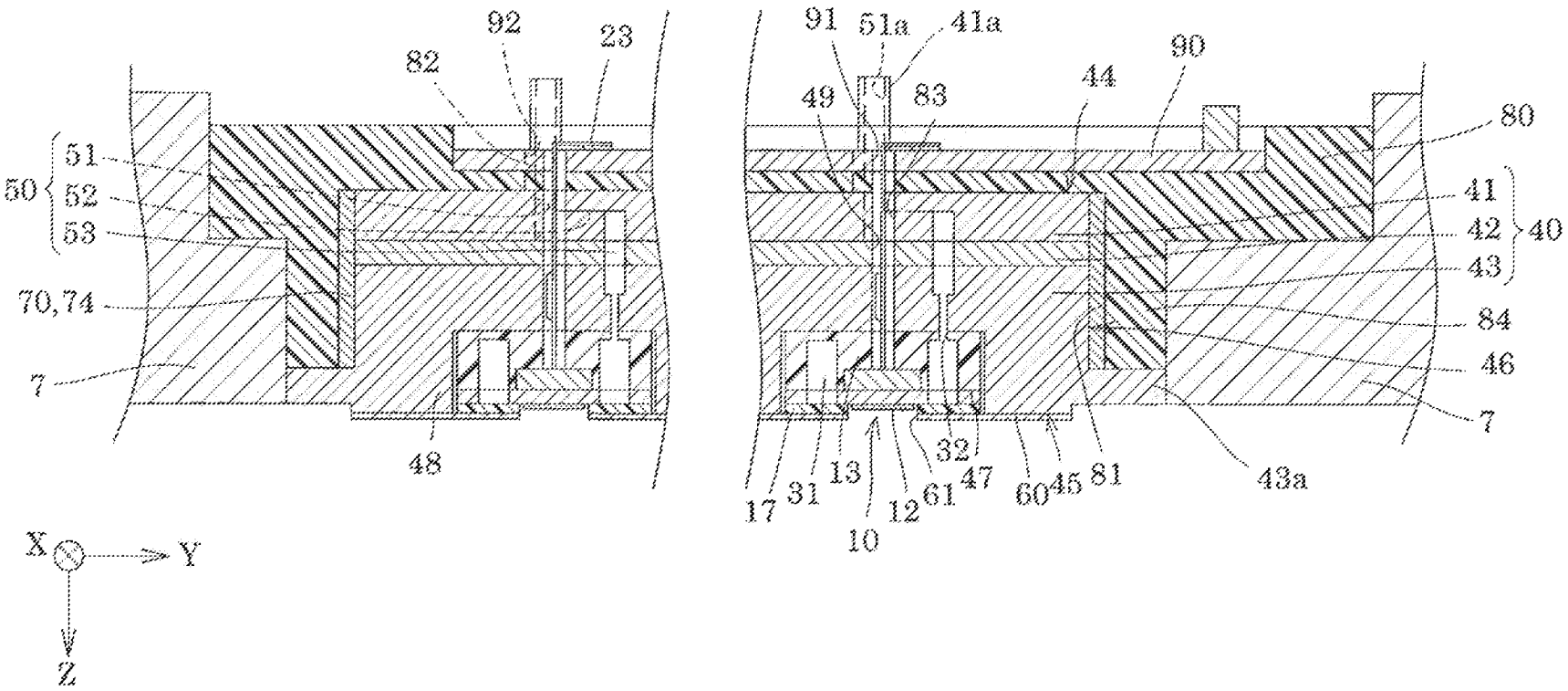
FIG. 13 is a sectional view of a main portion of the recording head and a holding member according to Embodiment 1.

Here, the recording head 1 of the above-described embodiment is mounted on an ink jet type recording apparatus I. The ink jet type recording apparatus I, which is an example of the liquid ejecting apparatus of the embodiment, will be described with reference to FIGS. 12 and 13. FIG. 12 is a view illustrating a schematic configuration of the ink jet type recording apparatus I, and FIG. 13 is a sectional view of a main portion of the recording head 1 and a holding member 7.

As illustrated in FIG. 12, the ink jet type recording apparatus I includes the recording head 1, a liquid container 3, a transport mechanism 4 for delivering a medium S, a control unit 5 which is a control unit, and a moving mechanism 6.

The liquid container 3 stores ink ejected from the recording head 1. Examples of the liquid container 3 include a cartridge that can be attached to and detached from the ink jet type recording apparatus I, a bag-like ink pack including a flexible film, an ink tank that can be refilled with ink, and the like. In the embodiment, as the liquid container 3, the cartridge provided to be attached to and detached from the recording head 1 is used. A plurality of types of inks having different colors or types are individually stored in the liquid container 3. In the embodiment, four colors of ink of cyan (C), fluorescent yellow (FY), fluorescent pink (FP), and black (K) are individually stored in the liquid container 3.

Although not particularly illustrated, the control unit 5 includes, for example, a control apparatus such as a central processing unit (CPU) or a field programmable gate array (FPGA) and a storage apparatus such as a semiconductor memory. The control unit 5 comprehensively controls each element of the ink jet type recording apparatus I, that is, the transport mechanism 4, the moving mechanism 6, the recording head 1, and the like by executing the program stored in the storage apparatus by the control apparatus.

The control unit 5 controls the heater 70 to control the temperature of the ink flowing through the second flow path 50. The control unit 5 of the embodiment controls the heater 70 based on the temperature measured by a temperature sensor (not illustrated) provided on the recording head 1. Although not particularly illustrated, the temperature sensor is preferably provided on the holder 40 so as to detect the temperature of the holder 40 provided with the second flow path 50. For example, the temperature sensor may be provided with the recess portion at the central part of the upper wall 44 of the holder 40 in the in-plane direction including the ±X direction and the ±Y direction, and may be disposed in the recess portion. Accordingly, the temperature of the ink flowing through the second flow path 50 can be easily acquired by the temperature sensor, and the temperature of the ink flowing through the second flow path 50 can be controlled by the heater 70 with relatively high accuracy. It is needless to say that the temperature sensor may be provided on the lower wall 45 side of the holder 40, but since the head chip 10 is fixed on the lower wall 45 side, there is a concern that the structure becomes complicated or the handling of the wiring of the temperature sensor becomes difficult, and thus, it is preferable to provide the temperature sensor on the upper wall 44 side. The temperature sensor may be provided on the relay substrate 90, on the holder cover 80, or on the fixing plate 60. The temperature sensor is not limited to the contact type, and may be a non-contact type.

In the embodiment, the control unit 5 that controls printing is also used to control the heater 70, but the disclosure is not particularly limited thereto, and for example, the control unit that controls the heater 70 may be provided separately from the control unit 5 that controls the printing. For example, by providing a temperature detecting unit such as a thermistor in the recording head 1, the control unit 5 may control the heater 70 such that the temperature of the target is detected and the target becomes a constant temperature.

The transport mechanism 4 is controlled by the control unit 5 to transport the medium S in the +X direction, and has, for example, a transport roller 4*a*. The transport mechanism 4 that transports the medium S is not limited to the transport roller 4*a*, and may transport the medium S by a belt or a drum.

The moving mechanism 6 is controlled by the control unit 5 to reciprocate the recording head 1 in the ±Y direction. The ±Y direction in which the recording head 1 reciprocates by the moving mechanism 6 is a direction intersecting the +X direction in which the medium S is transported.

Specifically, the moving mechanism 6 of the embodiment includes the holding member 7 for holding the recording head 1, a transport belt 8, and a guide rail 9. The holding member 7 is a substantially box-shaped structure for accommodating the recording head 1, a so-called carriage, and is fixed to the transport belt 8. The transport belt 8 is an endless belt erected along the ±Y direction. Under the control of the control unit 5, the driving force of a drive motor 8*a* is transmitted to the transport belt 8, and the rotation of the transport belt 8 causes the recording head 1 to reciprocate together with the holding member 7 along the guide rail 9 in the ±Y direction. It is also possible to mount the liquid container 3 in the apparatus main body 2 separately from the recording head 1.

Here, as illustrated in FIG. 13, the holding member 7 is disposed to sandwich the head outer wall 84 with the heater 70. The holding member 7 may include metal such as stainless steel or titanium, or may include resin. As the resin that forms the holding member 7, for example, the same material as the above-described case 13 can be used.

Here, the relationship between the temperatures of the second flow path 50, the head outer wall 84, and the holding member 7 due to the difference in the material of the holding member 7 will be described.

When the holding member 7 includes a metal material, the thermal conductivity is higher than that of the resin material, and thus, the temperature of the head outer wall 84 is greatly affected by the ambient temperature and is likely to decrease. On the other hand, when the holding member 7 includes a resin material, the thermal conductivity is lower than that of the metal material, and thus, the temperature of the head outer wall 84 is not easily affected by the ambient temperature and is unlikely to decrease. However, in the embodiment, regardless of the material of the holding member 7, since the plurality of second flow paths 50 are surrounded by the heater 70, the temperature of the ink flowing through the plurality of second flow paths 50 is substantially the same. However, since the metal material has a higher rigidity than that of the resin material, when the holding member 7 is formed of a metal material, the deformation of the holding member 7 is suppressed, and the deviation in the discharge direction of the ink droplets due to the deformation of the holding member 7 is unlikely to occur. On the other hand, since the resin material has a lower thermal conductivity than that of the metal material, when the holding member 7 is formed of a resin material, the heat dissipation of the heater 70 and the holder 40 can be suppressed, and the heater 70 can efficiently heat the holder 40. Since the resin material has a lower cost than that of the metal material, when the holding member 7 is formed of a resin material, the cost can be reduced.

In the embodiment, the common heater 70 is provided for the plurality of second flow paths 50 provided in the holder 40, and it is not necessary to provide the heater 70 for each second flow path 50, and thus, it is possible to suppress the increase in the number of components and reduce the cost, and it is possible to simplify the structure or the routing of the wiring coupled to the heater 70. Moreover, the recording head 1 can be miniaturized.

As described above, the ink jet type recording apparatus I, which is an example of the liquid ejecting apparatus of the embodiment, includes: the recording head 1 which is the above-described "liquid ejecting head"; and the holding member 7 that holds the recording head 1 and is formed of metal, and a part of the holding member 7 is disposed so as to sandwich the head outer wall 84 with the heater 70.

In this manner, by forming the holding member 7 with metal, it is possible to improve the rigidity of the holding member 7 and suppress the deformation of the holding member 7 as compared with a case where the holding member 7 includes resin. Therefore, it is possible to suppress the deviation or the like in the discharge direction of the ink droplets due to the deformation of the holding member 7. Even when the holding member 7 includes metal having a high thermal conductivity, the heater 70 can heat the second flow path 50 of the holder 40 provided on the side opposite to the holding member 7, and thus, it is possible to suppress occurrence of insufficient heating of ink flowing through the second flow path 50, and to suppress variation in the temperature of the ink flowing through the plurality of second flow paths 50.

The ink jet type recording apparatus I, which is an example of the liquid ejecting apparatus of the embodiment, may include: the recording head 1 which is the above-described "liquid ejecting head"; and the holding member 7 that holds the recording head 1 and is formed of resin, and a part of the holding member 7 may be disposed so as to sandwich the head outer wall 84 with the heater 70.

In this manner, by forming the holding member 7 with resin, the thermal conductivity of the holding member 7 can be lowered as compared with a case where the holding member 7 includes metal, and thus, the heat dissipation of the heater 70 and the holder 40 can be suppressed, and the heater 70 can efficiently heat the holder 40. By forming the holding member 7 with resin, the cost can be reduced as compared with a case where the holding member 7 includes metal.

The ink jet type recording apparatus I of the embodiment includes the recording head 1 which is the above-described "liquid ejecting head", and the control unit 5 which is a control unit that controls the heater 70. By controlling the heating temperature of the heater 70 by the control unit 5, the temperature of the ink in the second flow path 50 by the heater 70 can be controlled, and the ink having the optimum temperature can be supplied to the head chip 10.

The ink jet type recording apparatus I of the embodiment includes the recording head 1 which is the above-described "liquid ejecting head", and the liquid container 3 for storing ink which is a liquid ejected from the recording head 1. Ink, which is a liquid supplied from the liquid container 3, can be ejected from the recording head 1 to perform printing on the medium S.

Figure 14:
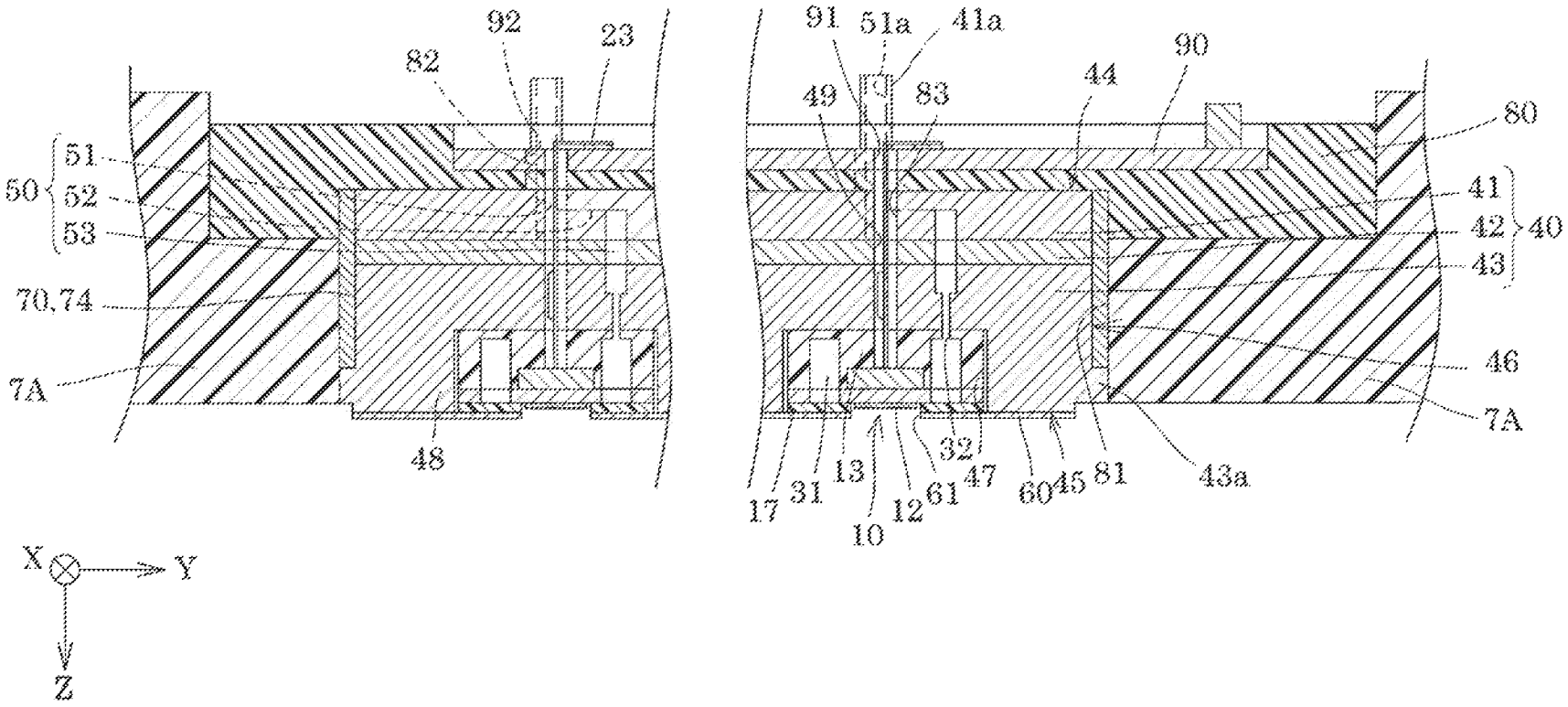
FIG. 14 is a sectional view of the main portion of the recording head and the holding member according to Embodiment 1.

In the embodiment, the holding member 7 is disposed so as to sandwich the head outer wall 84 with the heater 70, but the disclosure is not particularly limited thereto. Here, a modification example of the holding member 7 is illustrated in FIG. 14. FIG. 14 is a sectional view illustrating a main portion of the recording head 1 and a holding member 7A.

As illustrated in FIG. 14, the holding member 7A includes resin, and a part of the holding member 7A is disposed so as to sandwich the heater 70 with the holder 40. As the resin that forms the holding member 7A, for example, the same material as the above-described case 13 can be used.

In this manner, the holding member 7A includes resin, a part of the holding member 7A is disposed so as to sandwich the heater 70 with the holder 40, and accordingly, the holding member 7A having low thermal conductivity can cover the heater 70, the heat dissipation of the heater 70 and the holder 40 can be suppressed, and the heater 70 can efficiently heat the holder 40. By forming the holding member 7A with resin, the cost can be reduced as compared with a case where the holding member 7A includes metal.

Embodiment 2

Figure 15:
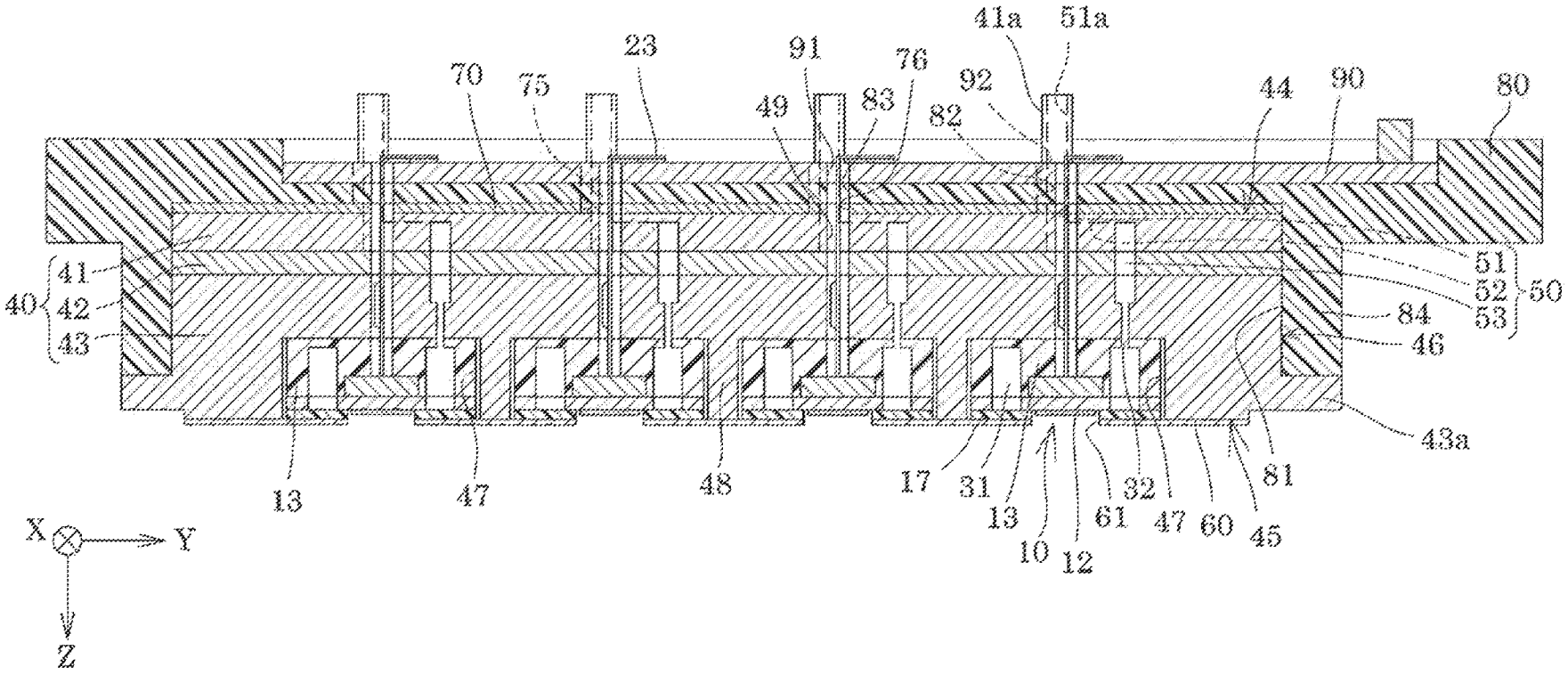
FIG. 15 is a sectional view of a recording head according to Embodiment 2.
Figure 16:
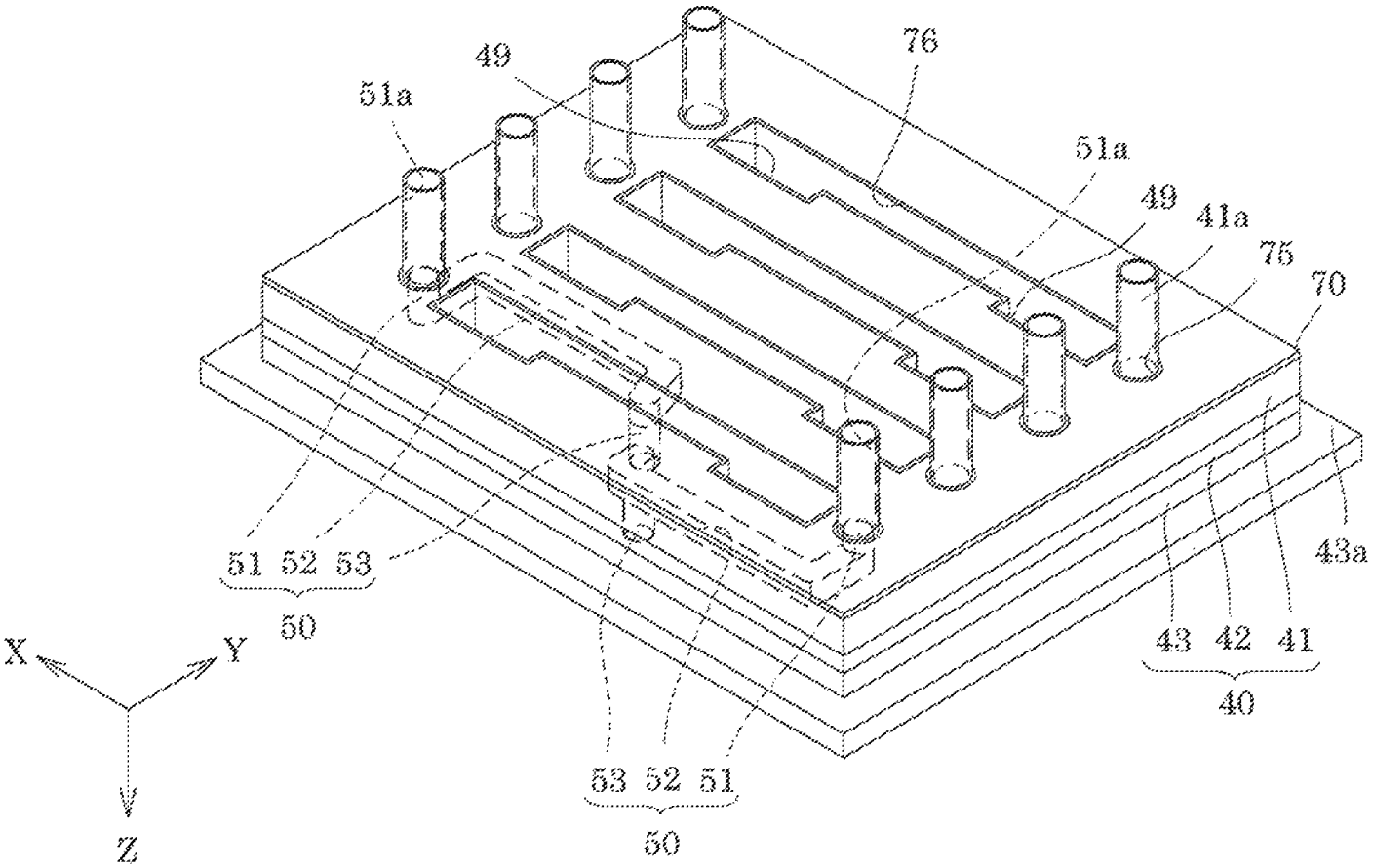
FIG. 16 is a perspective view of a holder and a heater according to Embodiment 2.
Figure 17:
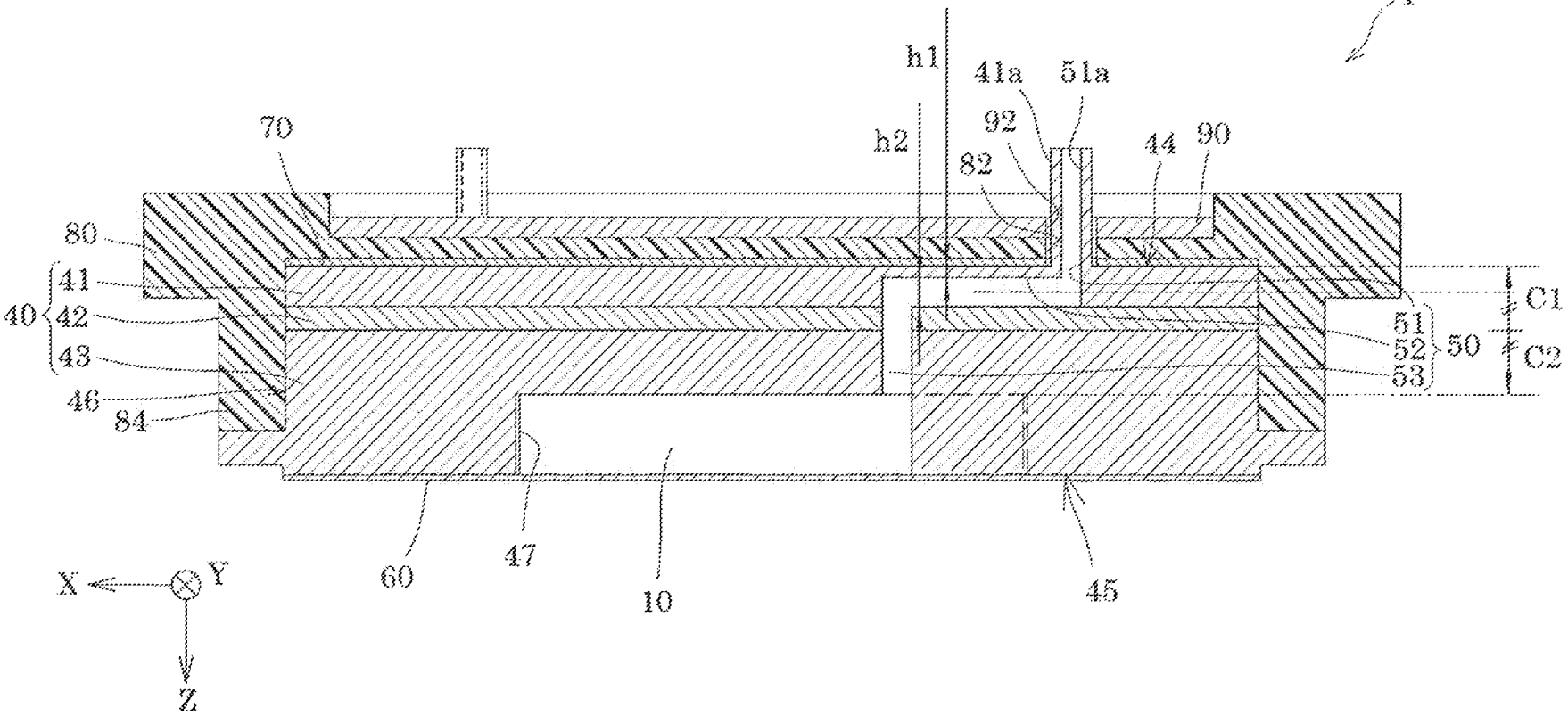
FIG. 17 is a sectional view of the recording head according to Embodiment 2.

FIG. 15 is a sectional view taken along line XV-XV of the ink jet type recording head 1 which is an example of the "liquid ejecting head" according to Embodiment 2 of the disclosure. FIG. 16 is a perspective view of the holder 40 and the heater 70 according to Embodiment 2. FIG. 17 is a sectional view taken along line XVII-XVII of the recording head 1. The same reference numerals will be given to the same members as those in the above-described embodiment, and redundant description thereof will be omitted.

As illustrated in FIG. 15, the recording head 1 of the embodiment includes the head chip 10, the holder 40, the fixing plate 60, the heater 70, the holder cover 80, and the relay substrate 90.

The holder 40 is provided with the second flow path 50. The second flow path 50 includes the first part 51, the second part 52, and the third part 53, similar to Embodiment 1 described above.

In the embodiment, the second part 52 is disposed closer to the upper wall 44 than the head chip 10. Here, the fact that the second part 52 is disposed closer to the upper wall 44 than the head chip 10 means that, as illustrated in FIG. 17, a center C1 of the second part 52 in the +Z direction is disposed closer to the upper wall 44 side than a center C2 between the bottom surface of the recess portion 47 to which the head chip 10 is fixed and the surface of the upper wall 44 on the −Z direction side. It is more preferable that a minimum thickness h1 in the ±Z direction of the part defining the second part 52 of the upper wall 44 of the first member 41 is smaller than a maximum height h2 of the second part 52 in the ±Z direction.

The heater 70 is disposed at a position overlapping the plurality of second parts 52 in a plan view when viewed in the +Z direction. The heater 70 is disposed on the upper wall 44 of the holder 40. In other words, the heater 70 is disposed at a position overlapping the second part 52 in a plan view when viewed in the +Z direction, on the surface on the −Z direction side, which is the upper wall 44 of the holder 40.

In the embodiment, the heater 70 is disposed so as to cover substantially the entire surface of the upper wall 44 of the holder 40 on the −Z direction side.

The heater 70 may be a film heater having flexibility, or may be a heater having no flexibility.

The heater 70 is provided with the projection portion 41*a* of the holder 40, that is, an opening portion 75 through which the coupling part 51*a* of the second flow path 50 is inserted. The coupling part 51*a* is pulled out from the heater 70 toward the −Z direction side through the opening portion 75.

The heater 70 is provided with a communication hole 76 that communicates with the first wiring insertion hole 49.

The wiring substrate 23 of the head chip 10 is pulled out to the −Z side through the communication hole 76 of the heater 70.

In this manner, by providing the heater 70 on the upper wall 44 of the holder 40, the second flow path 50 disposed in the vicinity of the head chip 10 can be heated by the heater 70, and thus, sufficiently heated ink can be supplied to the head chip 10. Since the holder 40 heated by the heater 70 includes metal or ceramics having high thermal conductivity, the heater 70 can sufficiently heat the ink flowing through the plurality of second flow paths 50 and sufficiently heated ink can also be supplied to the head chip 10 disposed at the position away from the heater 70. Therefore, it is possible to reduce the viscosity of the ink discharged from the head chip 10 and suppress the deterioration of the ink discharge characteristics. Furthermore, since the heater 70 is not configured to heat the head chip 10 itself, it is possible to simplify the configuration of the heater 70 and the configuration of the recording head 1.

In the recording head 1 of the embodiment, each of the plurality of second flow paths 50 has the second part 52 which is the "intersection part" that extends in the direction intersecting the +Z direction which is the "first direction", and the heater 70 is disposed at a position overlapping the plurality of second parts 52 in a plan view when viewed in the +Z direction.

In this manner, by disposing the heater 70 at a position overlapping the plurality of second parts 52, the length of the flow path heated by the heater 70 can be lengthened, and the ink flowing through the second flow path 50 can be effectively heated.

In the embodiment, the second part 52, which is the "intersection part", is provided between the first member 41 and the second member 42, but the disclosure is not particularly limited thereto, and the intersection part may be provided between the second member 42 and the third member 43.

In the embodiment, in each of the plurality of second flow paths 50, the second part 52 which is the "intersection part" and the third part 53 which is the "communication part" are provided one by one, but the disclosure is not particularly limited thereto. By providing the plurality of second parts 52 which are the "intersection parts" in the second flow path 50, the second flow path 50 may communicate with two or more "first flow paths", that is, the second flow path 50 may be a branch flow path for distributing the liquid to two or more "first flow paths". In other words, the number of second flow paths 50 does not necessarily have a one-to-one correspondence with the number of "first flow paths" as described in the embodiment, and the holder 40 may include the plurality of second flow paths 50 that communicate with at least one "first flow path" among the plurality of "first flow paths" included in the plurality of head chips 10 fixed to the holder 40.

Furthermore, the fact that the heater 70 is disposed at a position overlapping the second part 52 in a plan view when viewed in the +Z direction is not limited to a case where the heater 70 is provided on the upper wall 44 of the holder 40, and the heater 70 may be provided between the first member 41 and the second member 42 that configure the holder 40, or between the second member 42 and the third member 43. Even when the heater 70 is provided between the first member 41, the second member 42, and the third member 43, in a plan view when viewed in the +Z direction, when the heater 70 is disposed at the position overlapping the second part 52, the heater 70 can effectively heat the ink flowing through the second part 52. However, when the heater 70 is provided on the upper wall 44, as compared with a case where the heater 70 is provided between the first member 41 and the second member 42 or between the second member 42 and the third member 43, it is not necessary to incorporate the heater 70 between the laminated members that configure the holder 40 when assembling the holder 40. Therefore, when the heater 70 is provided on the upper wall 44, the holder 40 can be easily manufactured, or the heater 70 can be easily attached to the holder 40, and the wiring of the heater 70 can be easily handled.

In the embodiment, the holder 40 has the upper wall 44 provided on the −Z direction side, which is the second direction opposite to the +Z direction, which is the first direction of the holder 40, and the heater 70 is disposed on the upper wall 44. By disposing the heater 70 on the upper wall 44, the structure for installing the heater 70 is simplified as compared with a case where the heater 70 is disposed on the lower wall 45, and the wiring of the heater 70 can be easily routed.

Furthermore, in the embodiment, the second part 52, which is the "intersection part", is disposed closer to the upper wall 44 than the head chip 10. In this manner, since the second part 52, which is the "intersection part", is provided close to the upper wall 44 where the heater 70 is provided, the heater 70 can efficiently heat the ink flowing through the second part 52. It is more preferable that the minimum thickness h1 in the ±Z direction of the part defining the second part 52 of the upper wall 44 of the first member 41 is smaller than the maximum height h2 of the second part 52 in the ±Z direction. In this manner, by reducing the minimum thickness h1 in the ±Z direction of the part defining the second part 52 of the upper wall 44 of the first member 41 to be smaller than the maximum height h2 of the second part 52 in the ±Z direction, the second part 52 can be brought closer to the heater 70 provided on the surface of the upper wall 44 on the −Z direction side, and the ink flowing through the second part 52 can be easily heated by the heater 70.

Figure 18:
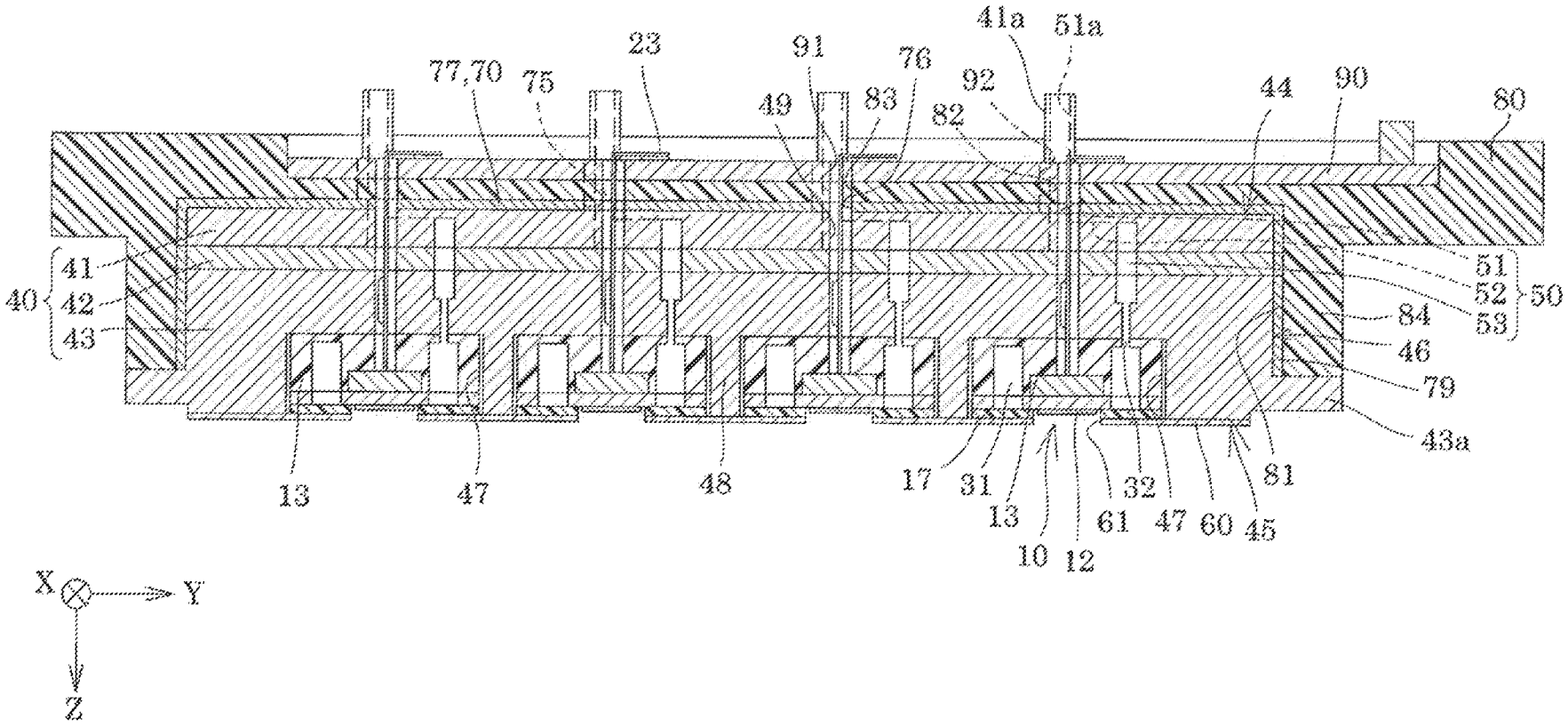
FIG. 18 is a sectional view illustrating a modification example of the recording head according to Embodiment 2.
Figure 19:
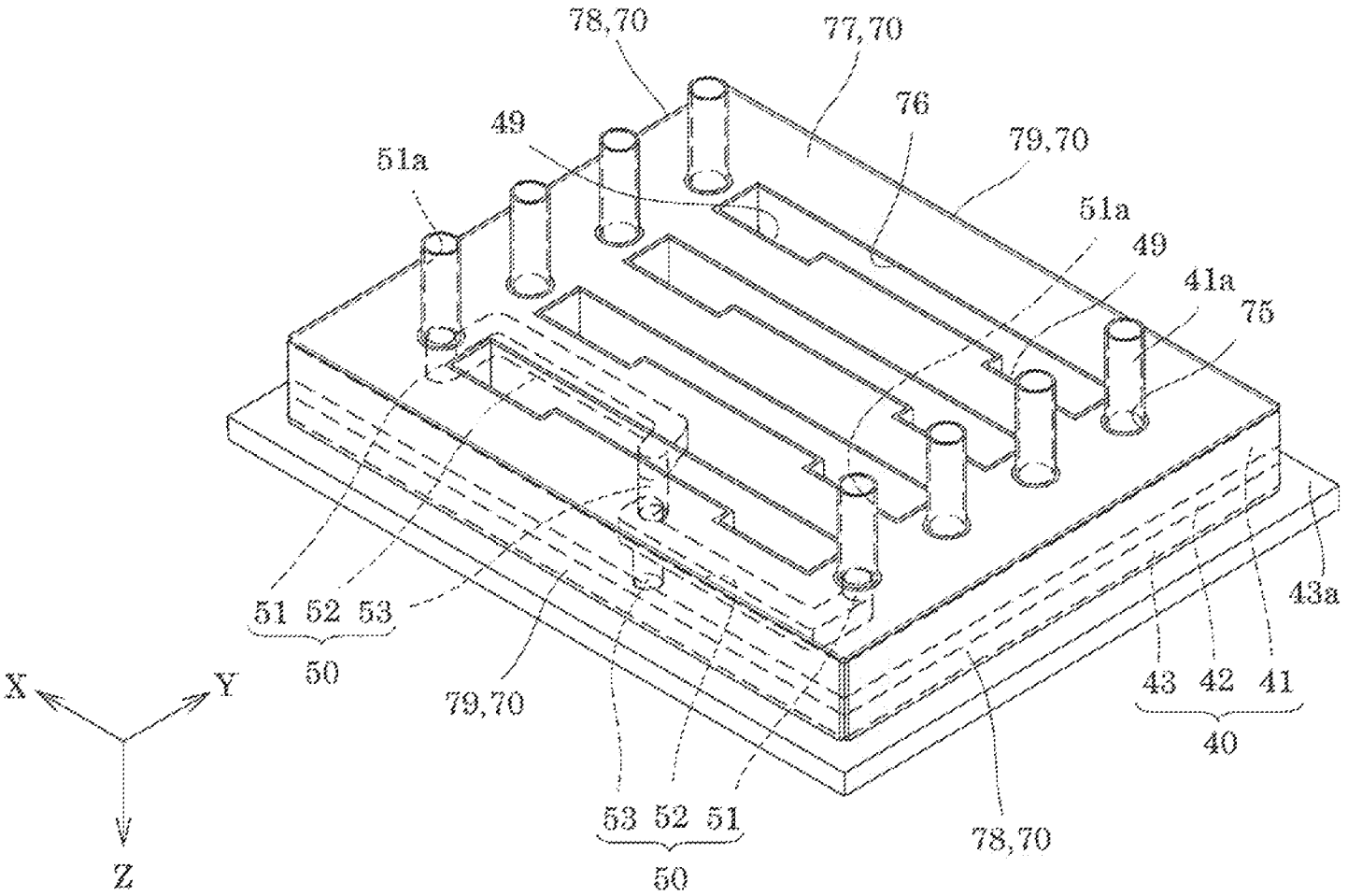
FIG. 19 is a perspective view illustrating a modification example of the holder and the heater according to Embodiment 2.

In the embodiment, the heater 70 is provided only on the upper wall 44, but the disclosure is not particularly limited thereto. Here, a modification example of the heater 70 will be described with reference to FIGS. 18 and 19. FIG. 18 is a sectional view of the recording head 1. FIG. 19 is a perspective view of the holder 40 and the heater 70.

As illustrated in FIGS. 18 and 19, the holder 40 has a side wall. The side wall refers to one side of the outer peripheral wall 46.

The heater 70 includes a flexible film heater. The heater 70 includes: a main body portion 77 provided on the upper wall 44; bent portions 78 provided on both side walls in the ±X direction; and bent portions 79 provided on both side walls in the ±Y direction. The bent portions 78 and 79 are bent at the end portion of the upper wall 44 with respect to the main body portion 77, and the main body portion 77 and the bent portions 78 and 79 are integrally provided.

In this manner, by integrally providing the heater 70 on the upper wall 44 and the side wall of the holder 40, the heater 70 can perform heating while suppressing variation in the temperature of the entire holder 40. Therefore, it is possible to suppress variation in the temperature of the ink flowing through the plurality of second flow paths 50 heated by the heater 70.

In the embodiment, the bent portions 78 are provided on both side surfaces in the ±X direction, and the bent portions 78 are provided on both side surfaces in the ±Y direction, but the disclosure is not particularly limited thereto, and only one of the bent portions 78 and the bent portions 79 may be provided. Of the bent portions 78 provided on the side walls on both sides in the ±X direction, only one of the bent portion 78 provided on the side wall in the +X direction and the bent portion 78 provided on the side wall in the −X direction may be provided. Of the bent portions 79 provided on the side walls on both sides in the ±Y direction, only one of the bent portion 79 provided on the side wall in the +Y direction and the bent portion 79 provided on the side wall in the −Y direction may be provided.

As described above, in the recording head 1 of the embodiment, the holder 40 has a side wall, and the heater 70 is a film heater having flexibility, and includes the main body portion 77 fixed to the upper wall 44 and the bent portions 78 and 79 that are bent at the end portion of the upper wall 44 with respect to the main body portion 77 and fixed to the side wall.

In this manner, by integrally providing the heater 70 on the upper wall 44 and the side wall of the holder 40, the heater 70 can perform heating while suppressing variation in the temperature of the entire holder 40. Therefore, it is possible to suppress variation in the temperature of the ink flowing through the plurality of second flow paths 50 heated by the heater 70. Since the bent portions 78 and 79 fixed to the side wall can be formed only by bending the main body portion 77 of the heater 70 at the end portion of the upper wall 44, the second flow path 50 can be efficiently heated with a simple film heater configuration.

In the recording head 1 of the embodiment, it is preferable that each of the plurality of second flow paths 50 has the coupling part 51*a* that protrudes from the upper wall 44 of the holder 40 in the −Z direction which is the "second direction" opposite to the +Z direction, and the heater 70 has the opening portions 75 which are the plurality of openings through which each of the plurality of coupling parts 51*a* is inserted. According to this, even when the coupling part 51*a* protrudes from the upper wall 44 of the holder 40 in the −Z direction, the heater 70 is provided with the opening portion 75 corresponding to the coupling part 51*a*, and thus, the heater 70 can be simply attached to the holder 40. By providing the opening portion 75 in the heater 70, the heater 70 can be disposed in the vicinity of the coupling part 51*a* and the second flow path 50 that communicates with the coupling part 51*a*, for example, the first part 51 or the second part 52, and thus, the heater 70 can efficiently perform the heating. Incidentally, it is conceivable that the heater 70 is not provided with the opening portion 75 and the heater 70 is divided into a plurality of parts and disposed on the upper wall 44 so as to avoid the coupling part 51*a*, but in this case, there is a concern that the number of components such as the heater 70 increases and the configuration becomes complicated.

Other Embodiments

Although each embodiment of the disclosure has been described above, the basic configuration of the disclosure is not limited to the above-described one.

In each of the above-described embodiments, as the "first flow path" provided in the head case 13, the introduction port 32 and the introduction liquid chamber 31 for supplying ink into the head chip 10 are exemplified, but the disclosure is not particularly limited thereto. The head chip 10 may include a discharge path for discharging ink from the head chip 10 to the outside, as the "first flow path", a circulation path for circulating ink between the head chip 10 and the liquid container 3, and the like. Similarly, in each of the above-described embodiments, an example is described in which the second flow path 50 of the holder 40 supplies ink to the head chip 10, but the disclosure is not particularly limited thereto. As the second flow path 50, the holder 40 may include a discharge path for further discharging the ink discharged from the head chip 10 to the outside, a circulation path for circulating the ink between the head chip 10 and the liquid container 3, and the like.

For example, in each of the above-described embodiments, an example is described in which the holder 40 is configured with three members, such as the first member 41, the second member 42, and the third member 43, but the disclosure is not particularly limited thereto. The holder 40 may be configured with a single member, or configured with two or more members. The laminating direction of the plurality of members that configure the holder 40 is not limited to the +Z direction, and may be laminated in the +X direction, the +Y direction, or the like. However, when the second part 52, which is the "intersection part", is provided in the second flow path 50, a case where the plurality of members are laminated in the +Z direction is preferable since it is easier to form the second part 52.

The energy generating element of the head chip 10 is not limited to the piezoelectric actuator 18, and various well-known configurations can be adopted. For example, as an energy generating element that causes the pressure fluctuation in the ink in the pressure chamber 19, for example, the one that changes the volume of the flow path by deformation of the piezoelectric actuator having a piezoelectric material exhibiting an electromechanical conversion function, causes the pressure change in the ink in the flow path, and discharges the ink droplets from the nozzle 11 can be used. As the energy generating element, the one in which a heat generating element is disposed in the flow path and ink droplets are discharged from the nozzle 11 by a bubble generated by the heat generated by the heat generating element can be used. As the energy generating element, a so-called electrostatic actuator or the like, which generates an electrostatic force between the diaphragm and the electrode, deforms the diaphragm by the electrostatic force, and discharges ink droplets from the nozzle 11 can be used.

Figure 20:
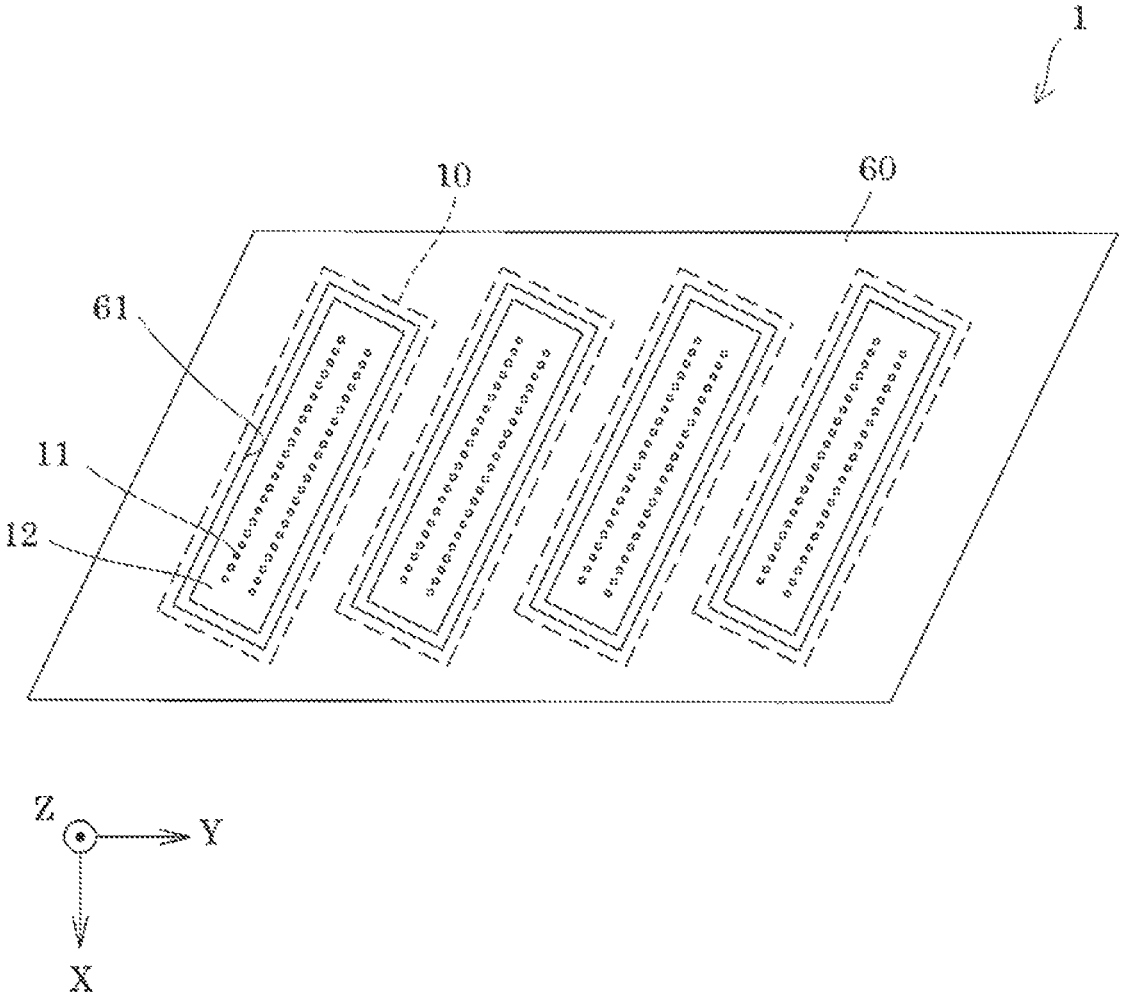
FIG. 20 is a bottom view of the recording head according to another embodiment.

In each of the above-described embodiments, the configuration is exemplified in which the parallel direction of the nozzles 11 is the same +X direction as the transport direction of the medium S, but the disclosure is not particularly limited thereto. For example, as illustrated in FIG. 20, the parallel direction of the nozzles 11 may be inclined with respect to the +X direction, which is the transport direction of the medium S.

Figure 21:
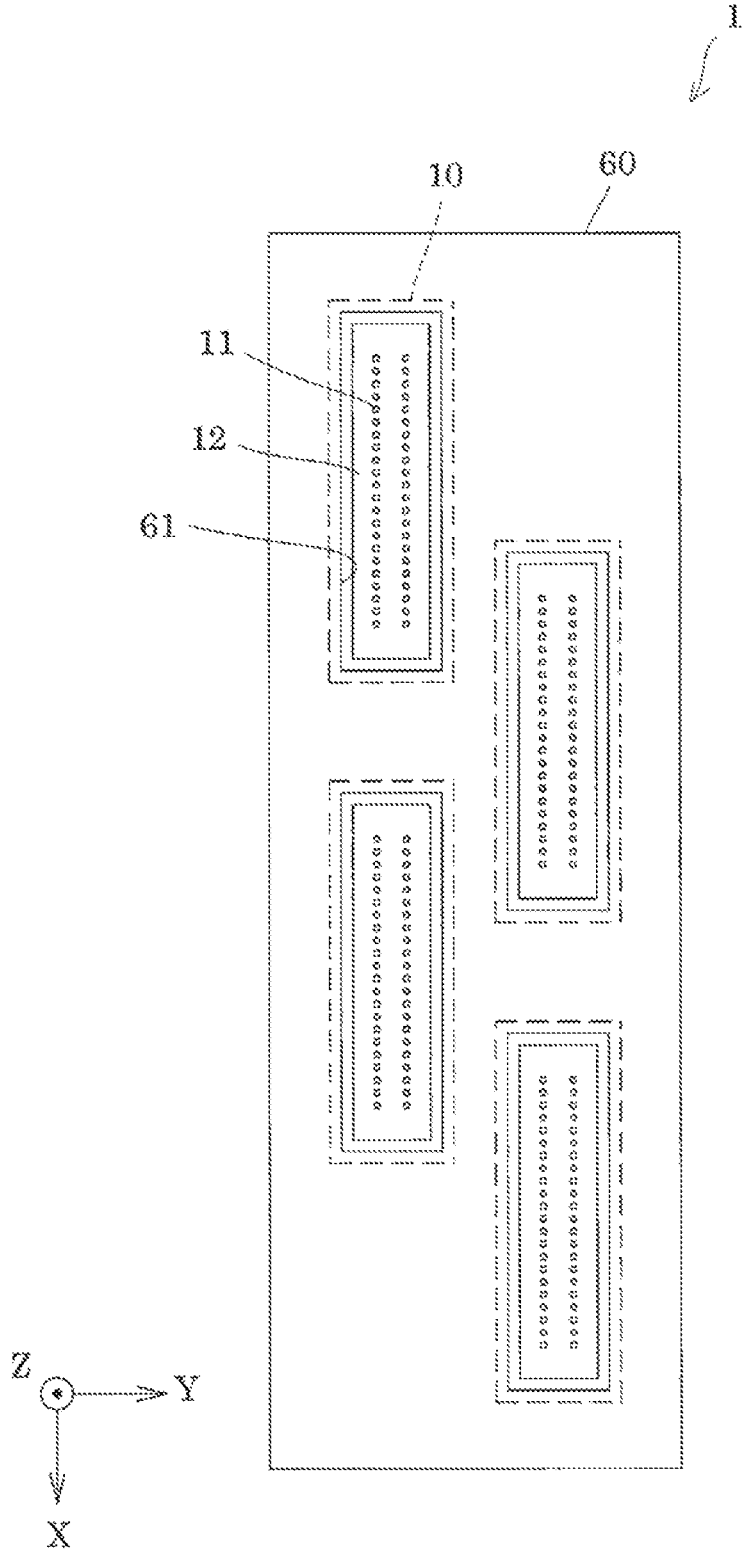
FIG. 21 is a bottom view of the recording head according to another embodiment.

In each of the above-described embodiments, a configuration is exemplified in which the plurality of head chips 10 are disposed in the +Y direction such that the positions in the +X direction are the same, but the disclosure is not particularly limited thereto. For example, as illustrated in FIG. 21, a plurality of head chips 10 may be disposed in a staggered pattern along the +X direction. Here, arrangement of the plurality of head chips 10 in a staggered pattern along the +X direction means that the head chips 10 arranged side by side in the +X direction are alternately disposed so as to be deviated in the Y direction. In other words, the rows of the head chips 10 arranged side by side in the +X direction are arranged side by side in two rows in the +Y direction, and the rows of the two rows of head chips 10 are arranged with a half pitch deviation in the +X direction. By disposing the head chips 10 in a staggered pattern along the +X direction in this manner, the nozzles 11 of the two head chips 10 are partially overlapped, and continuous rows of nozzles 11 in the +X direction can be formed.

For example, in Embodiments 1 and 2 described above, when reading the recording head 1 as a head chip and the holding member as a holder, in a head module including: the plurality of recording heads 1 which is not provided with the heater 70; and the holding member provided with a flow path that holds the plurality of recording heads 1 and supplies ink to the plurality of recording heads, for example, a holding member provided with the branch flow path, the disclosure can be applied to the head module. In other words, in the head module, a heater may be provided in the holding member corresponding to the holder.

In each of the above-described embodiments, the projection portion 41*a* is provided so as to protrude from the upper wall 44, but a configuration may be provided so as to protrude from the side wall.

In the above-described ink jet type recording apparatus I, an example is described in which the recording head 1 is mounted on the holding member 7 and moves in the ±Y direction, which is the main scanning direction, but the disclosure is not particularly limited thereto. For example, the disclosure can also be applied to a so-called line type recording apparatus in which the plurality of recording heads 1 are arranged in a direction orthogonal to the transport direction of the medium S and are fixed to the unit base, and printing is performed simply by moving the medium S in the transport direction. Also in this case, when the recording head 1 is read as a head chip, the flow path structure that distributes the liquid to the plurality of recording heads 1 is read as a holder, and the unit base is read as a holding member, by providing a heater to the flow path structure corresponding to the holder, the disclosure can be applied. It is needless to say that, when each of the recording heads 1 has a plurality of head chips, the disclosure may be applied to each of the recording heads 1.

In the above-described embodiments, the ink jet type recording head is described as an example of the liquid ejecting head, and the ink jet type recording apparatus is described as an example of the liquid ejecting apparatus, but the disclosure can be broadly applied to liquid ejecting heads and liquid ejecting apparatuses in general, and it is needless to say that the disclosure can be applied to a liquid ejecting head or a liquid ejecting apparatus which ejects liquid other than ink. Examples of the other types of liquid ejecting head include various recording heads used for image recording apparatuses, such as a printer, a color material ejecting head used for manufacturing a color filter, such as a liquid crystal display, an electrode material ejecting head used for forming electrodes, such as an organic EL display or a field emission display (FED), and a bioorganic material ejecting head used for manufacturing a bio chip, and the disclosure can be applied to liquid ejecting apparatuses including the liquid ejecting heads.

What is claimed is:

1. A liquid ejecting head comprising:
- a plurality of head chips respectively having:
  - a nozzle plate having a plurality of nozzles configured to eject a liquid in a first direction; and
  - a case having one or more first flow paths communicating with at least a part of the plurality of nozzles;
- a holder to which the plurality of head chips are fixed, which includes metal or ceramics, which has a plurality of second flow paths communicating with at least one of the plurality of first flow paths, and which does not include a nozzle plate; and
- a heater configured to heat the holder.

2. The liquid ejecting head according to claim 1, wherein the case includes resin.

3. The liquid ejecting head according to claim 1, wherein
- the heater surrounds the plurality of second flow paths in a plan view and overlaps at least a part of the second flow paths when viewed in a direction orthogonal to the first direction.

4. The liquid ejecting head according to claim 3, wherein
- the second flow path includes
  - an intersection part that extends in a direction intersecting the first direction, and
  - a communication part that extends in the first direction and brings the intersection part into communication with the first flow path of the case, and
- the heater is disposed so as to overlap the intersection part and the communication part when viewed in a direction orthogonal to the first direction.

5. The liquid ejecting head according to claim 1, wherein
- the holder has an outer peripheral wall that surrounds the plurality of second flow paths in a plan view, and
- the heater is a film heater having flexibility, which is wound so as to cover the entire periphery of the outer peripheral wall in a plan view and is fixed to the outer peripheral wall.

6. The liquid ejecting head according to claim 5, wherein
- the plurality of head chips are disposed side by side in a third direction orthogonal to the first direction,
- the heater includes
  - a first part that extends in the third direction, and
  - a second part that extends in a direction orthogonal to the first direction and intersecting the third direction, and
- a calorific value per unit area of the first part is greater than a calorific value per unit area of the second part.

7. The liquid ejecting head according to claim 1, wherein
- each of the plurality of second flow paths has an intersection part that extends in a direction intersecting the first direction, and
- the heater overlaps a plurality of the intersection parts in a plan view when viewed in the first direction.

8. The liquid ejecting head according to claim 7, wherein
- the holder has an upper wall provided on a second direction side of the holder opposite to the first direction, and
- the heater is disposed on the upper wall.

9. The liquid ejecting head according to claim 8, wherein
- the intersection part is disposed closer to the upper wall than is the head chip.

10. The liquid ejecting head according to claim 8, wherein
- the holder has a side wall, and
- the heater
  - is a film heater having flexibility, and
  - includes a main body portion fixed to the upper wall and a bent portion that is bent at an end portion of the upper wall with respect to the main body portion and fixed to the side wall.

11. The liquid ejecting head according to claim 8, wherein
- each of the plurality of second flow paths has a coupling part that protrudes from the upper wall of the holder in a second direction opposite to the first direction, and
- the heater has a plurality of openings through which each of a plurality of the coupling parts is inserted.

12. The liquid ejecting head according to claim 1, further comprising:
- a fixing plate which has a plurality of openings for exposing the plurality of nozzles of the head chip, and includes metal,
- the holder has a lower wall to which the plurality of head chips and the fixing plate are fixed, and the lower wall has a plurality of recess portions for accommodating each of the plurality of head chips.

13. The liquid ejecting head according to claim 1, wherein the liquid is an ultraviolet curable type ink or a solvent-based ink.

14. The liquid ejecting head according to claim 1, further comprising:

a head outer wall disposed so as to sandwich the heater with the holder, wherein the head outer wall has a lower thermal conductivity than that of the holder.

15. A liquid ejecting apparatus comprising:

the liquid ejecting head according to claim 14; and a holding member that holds the liquid ejecting head and includes metal, wherein a part of the holding member is disposed so as to sandwich the head outer wall with the heater.

16. A liquid ejecting apparatus comprising:

the liquid ejecting head according to claim 14; and a holding member that holds the liquid ejecting head and includes resin, wherein a part of the holding member is disposed so as to sandwich the head outer wall with the heater.

17. A liquid ejecting apparatus comprising:

the liquid ejecting head according to claim 1; and a holding member that holds the liquid ejecting head and includes resin, wherein a part of the holding member is disposed so as to sandwich the heater with the holder.

18. A liquid ejecting apparatus comprising:

the liquid ejecting head according to claim 1; and a control unit that controls the heater.

19. A liquid ejecting apparatus comprising:

the liquid ejecting head according to claim 1; and a liquid container for storing a liquid ejected from the liquid ejecting head.

* * * * *